US009665048B2

(12) United States Patent
Iwasaki et al.

(10) Patent No.: US 9,665,048 B2
(45) Date of Patent: May 30, 2017

(54) IMAGE FORMING APPARATUS HAVING A TEMPERATURE SETTING PORTION TO CONTROL A TARGET TEMPERATURE

(71) Applicant: CANON KABUSHIKI KAISHA, Tokyo (JP)

(72) Inventors: Atsushi Iwasaki, Susono (JP); Masatoshi Itoh, Mishima (JP); Tetsuya Yamamoto, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/089,903

(22) Filed: Apr. 4, 2016

(65) Prior Publication Data

US 2016/0216666 A1 Jul. 28, 2016

Related U.S. Application Data

(62) Division of application No. 14/043,316, filed on Oct. 1, 2013, now Pat. No. 9,335,709.

(30) Foreign Application Priority Data

Oct. 3, 2012 (JP) ..... 2012-221314
Oct. 25, 2012 (JP) ..... 2012-235436

(51) Int. Cl.
*G03G 15/20* (2006.01)
*G03G 15/00* (2006.01)

(52) U.S. Cl.
CPC ..... *G03G 15/2039* (2013.01); *G03G 15/80* (2013.01)

(58) Field of Classification Search
CPC ... G03G 15/2039; G03G 15/80; G03G 15/205
USPC ..... 399/69, 70
See application file for complete search history.

(56) References Cited

U.S. PATENT DOCUMENTS 7,193,181 B2 3/2007 Makihira et al.
7,242,895 B2 7/2007 Inada et al.
7,283,145 B2 10/2007 Kato et al.
7,305,208 B2 12/2007 Inoue et al.
7,366,455 B2 * 4/2008 Iwasaki ..... G03G 15/2042 399/329

(Continued)

FOREIGN PATENT DOCUMENTS

JP 2006-98998 A 4/2006

*Primary Examiner* — Walter L Lindsay, Jr.
*Assistant Examiner* — Ruth Labombard
(74) *Attorney, Agent, or Firm* — Fitzpatrick, Cella, Harper & Scinto

(57) ABSTRACT

An image forming apparatus includes: a fixing portion for fixing an image, formed on a recording material, on the recording material, wherein the fixing portion includes a heater for generating heat by electric power supplied from a commercial power source; a power source portion for supplying the electric power to a load except the heater, wherein the power source and the heater are connected with the commercial power source in parallel; a suppliable electric power calculating portion for calculating suppliable electric power suppliable to the heater; and a temperature setting portion for setting, depending on the suppliable electric power calculated by the calculating portion, a control target temperature of the fixing portion in an operation in a stand-by mode in which the image forming apparatus awaits a print instruction.

6 Claims, 26 Drawing Sheets

| | A | B | C |
|---|---|---|---|
| STAND-BY(170°C) | 5s | 7s | 9s |
| STAND-BY(140°C) | 6s | 8s | 10s |
| STAND-BY(100°C) | 7s | 9s | 11s |
| NO STAND-BY | 9s | 11s | 13s |

(56) References Cited

U.S. PATENT DOCUMENTS

| | | | | |
|---|---|---|---|---|
| 7,469,120 | B2 | 12/2008 | Iwasaki et al. | |
| 7,653,320 | B2 | 1/2010 | Ota et al. | |
| 7,865,120 | B2 | 1/2011 | Suzuki et al. | |
| 7,974,563 | B2 | 7/2011 | Sakai et al. | |
| 8,005,413 | B2 | 8/2011 | Sakakibara et al. | |
| 8,224,223 | B2 | 7/2012 | Sakakibara et al. | |
| 8,369,763 | B2 | 2/2013 | Sakakibara et al. | |
| 8,626,046 | B2 | 1/2014 | Sekihara et al. | |
| 2005/0169657 | A1 | 8/2005 | Hanamoto et al. | |
| 2007/0098431 | A1* | 5/2007 | Sugiyama ..... | G03G 15/80 399/88 |

* cited by examiner

| | A | B | C |
|---|---|---|---|
| STAND-BY(170°C) | 5s | 7s | 9s |
| STAND-BY(140°C) | 6s | 8s | 10s |
| STAND-BY(100°C) | 7s | 9s | 11s |
| NO STAND-BY | 9s | 11s | 13s |

| SPPLY PWR | STAND-BY TMP. |
|---|---|
| 1500W | 60°C |
| 1400W | 80°C |
| 1300W | 100°C |
| 1200W | 120°C |
| 1100W | 140°C |
| 1000W | 160°C |

| OPTN LOAD | USE PWR |
|---|---|
| ADF | 100W |
| IMG SCNNR | 200W |
| FDNG OPTN | 50W |
| DSCHRG OPTN | 50W |

| | A | B | C |
|---|---|---|---|
| STAND-BY(170°C) | 5s | 7s | 9s |
| STAND-BY(140°C) | 6s | 8s | 10s |
| STAND-BY(100°C) | 7s | 9s | 12s |
| NO STAND-BY | 9s | 11s | 13s |

IMAGE FORMING APPARATUS HAVING A TEMPERATURE SETTING PORTION TO CONTROL A TARGET TEMPERATURE

This is a divisional of U.S. patent application Ser. No. 14/043,316, filed on Oct. 1, 2013.

FIELD OF THE INVENTION AND RELATED ART

The present invention relates to an image forming apparatus.

In recent years, speed-up and colorization of the image forming apparatus such as a copying machine or a printer have been advanced. In the case of such a high-speed printer or color printer, there is a tendency that a control target temperature of a fixing device (apparatus) when a toner image formed on recording paper is heat-fixed is required to be increased. Further, in the case of such a high-speed printer or color printer, there is a tendency that electric power consumption at a portion other than the fixing device in the printer is large and thus electric power capable of being assigned to the fixing device becomes small. When the electric power to be assigned to the fixing device is decreased, a time from input of an image forming request into the printer until a temperature of the fixing device is increased up to a fixable temperature becomes long. However, a time from the input of the image forming request until first recording paper is discharged, i.e., so-called first print out time (FPOT) may preferably be short to the possible extent. Japanese Laid-Open Patent Application (JP-A) 2006-98998 discloses a constitution in which shortening of the FPOT is realized by warming the fixing device to some extent during an operation in a stand-by mode in which the image forming apparatus waits the image forming request.

The control target temperature during the operation in the stand-by mode has been conventionally set at a high value so as to satisfy a desired FPOT irrespective of a state of the fixing device. However, in the case where the desired FPOT is satisfied even when the control target temperature during the operation in the stand-by mode is set at a low value, the temperature setting at the high value leads to waste of electric power.

SUMMARY OF THE INVENTION

A principal object of the present invention is to provide an image forming apparatus capable of more effectively realizing reduction in electric power consumption.

According to an aspect of the present invention, there is provided an image forming apparatus comprising: a fixing portion for fixing an image, formed on a recording material, on the recording material, wherein the fixing portion includes a heater for generating heat by electric power supplied from a commercial power source; a power source portion for supplying the electric power to a load except the heater, wherein the power source and the heater are connected with the commercial power source in parallel; a suppliable electric power calculating portion for calculating suppliable electric power suppliable to the heater; and a temperature setting portion for setting, depending on the suppliable electric power calculated by the calculating portion, a control target temperature of the fixing portion in an operation in a stand-by mode in which the image forming apparatus awaits a print instruction.

According to another aspect of the present invention, there is provided an image forming apparatus comprising: a fixing portion for fixing an image, formed on a recording material, on the recording material; an electric power consumption calculating portion for calculating electric power consumption of the fixing portion, wherein the calculating portion calculates the electric power consumption when the electric power is supplied so that a control target temperature in an operation in a stand-by mode in which the fixing portion awaits a print instruction; and a temperature setting portion for setting, depending on the electric power consumption calculated by the calculating portion, the control target temperature in the operation in the stand-by mode.

These and other objects, features and advantages of the present invention will become more apparent upon a consideration of the following description of the preferred embodiments of the present invention taken in conjunction with the accompanying drawings.

Figure 2:
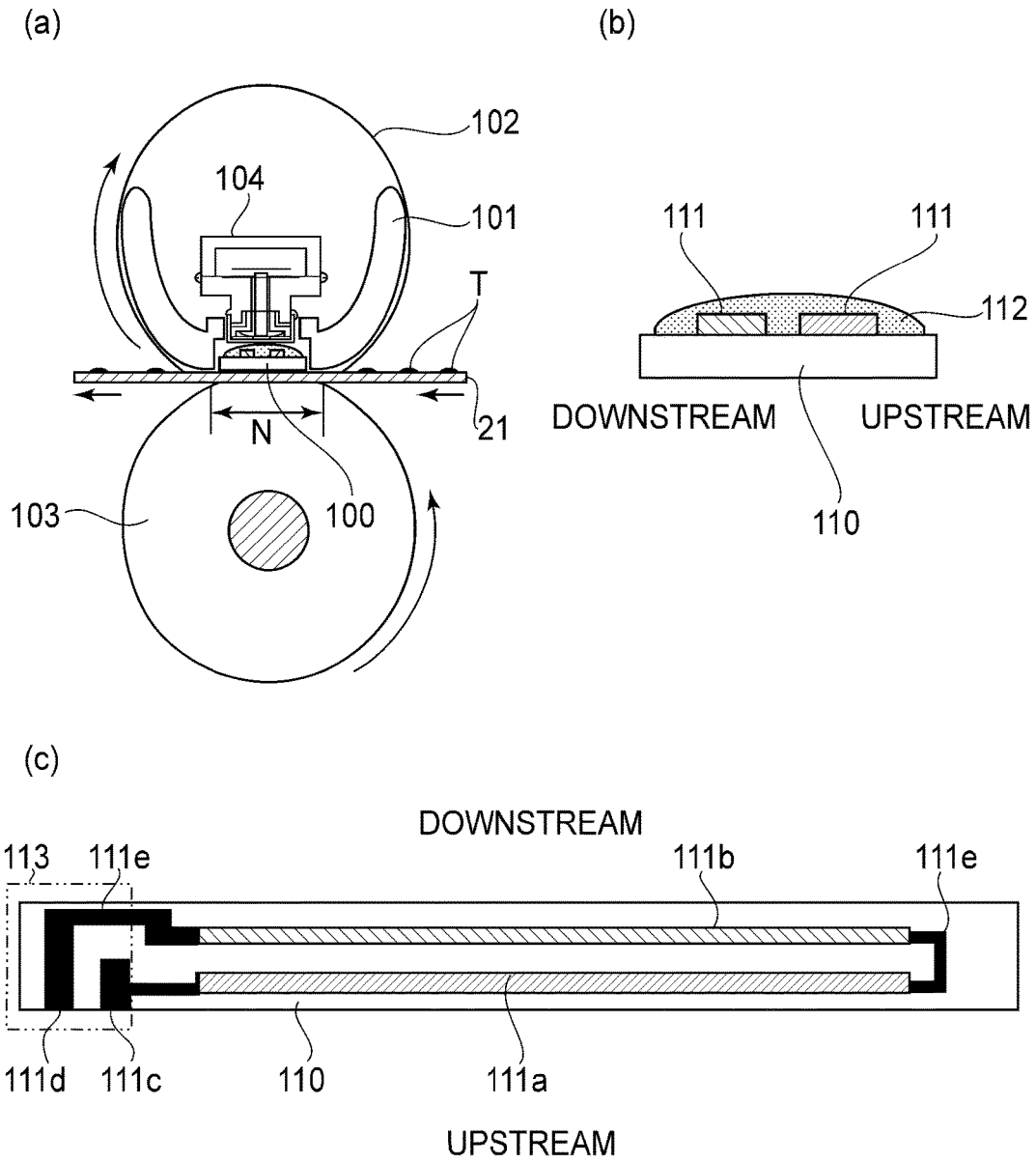

Parts (a) to (c) of FIG. 2 are schematic views for illustrating a structure of a fixing device in Embodiment 1.

Figure 3:
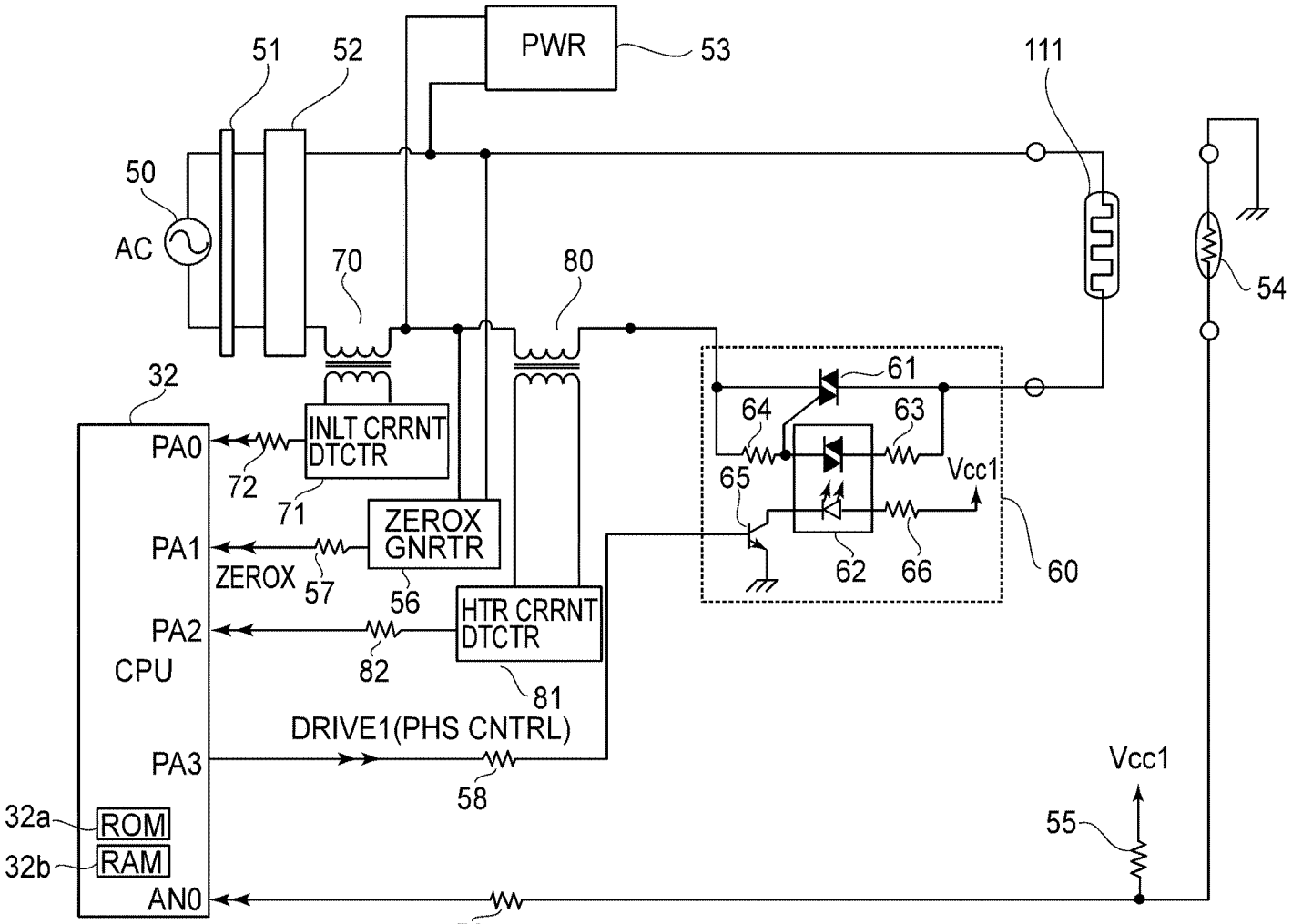

FIG. 3 is a diagram for illustrating a heater driving circuit in Embodiment 1.

Figure 4:
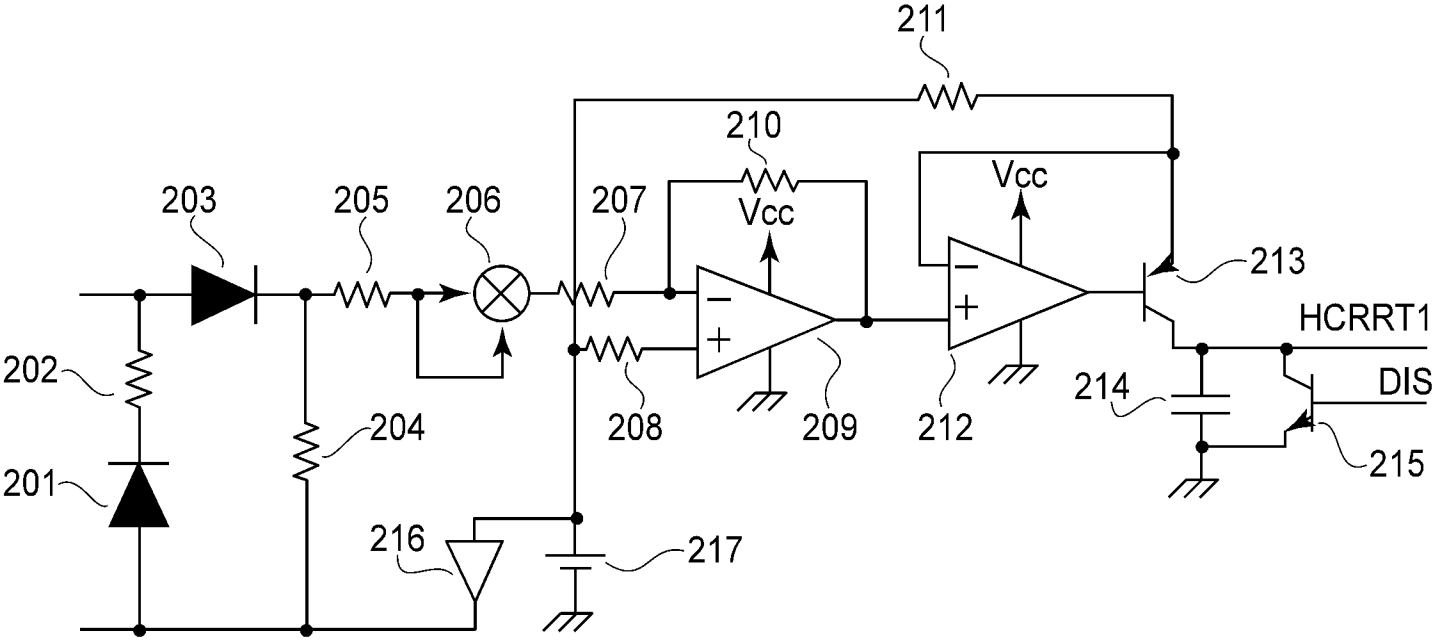

FIG. 4 is a diagram for illustrating a heater detecting circuit in Embodiment 1.

Figure 5:
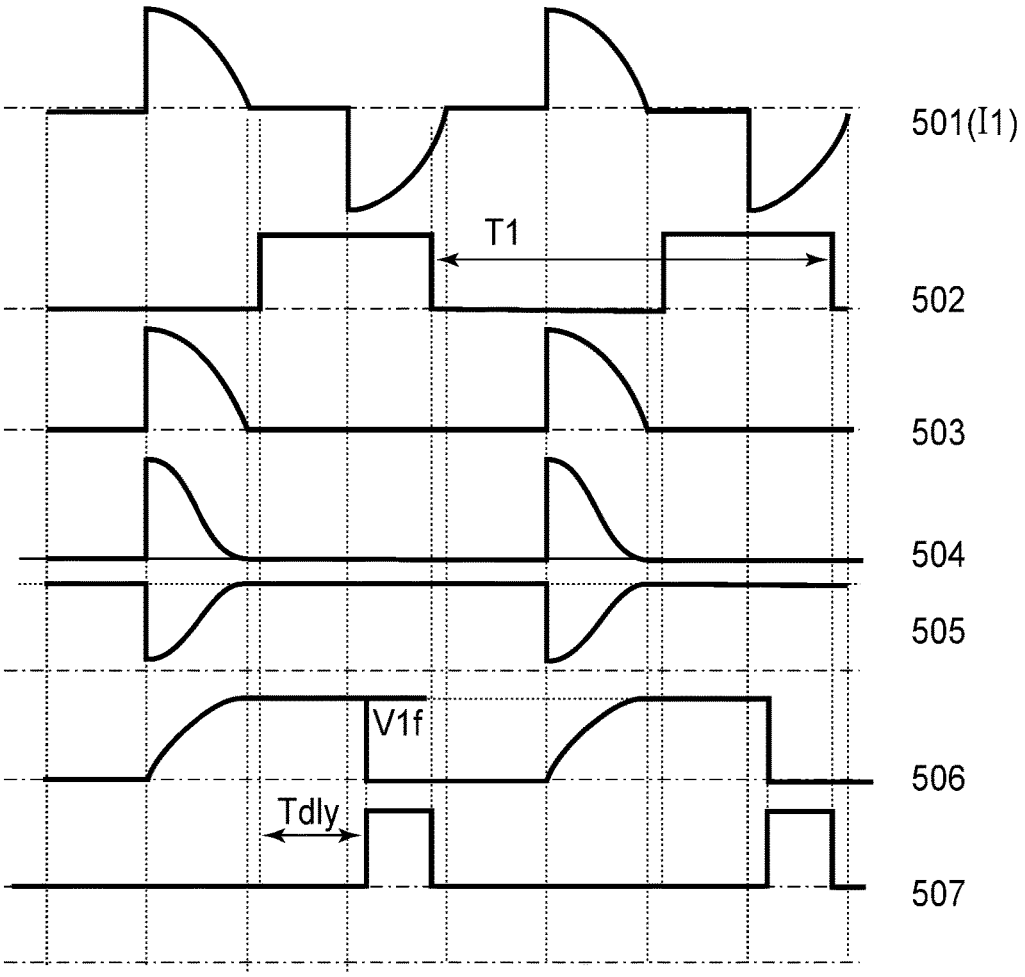

FIG. 5 is a waveform chart for illustrating an operation of the heater current detecting circuit in Embodiment 1.

Figure 6:
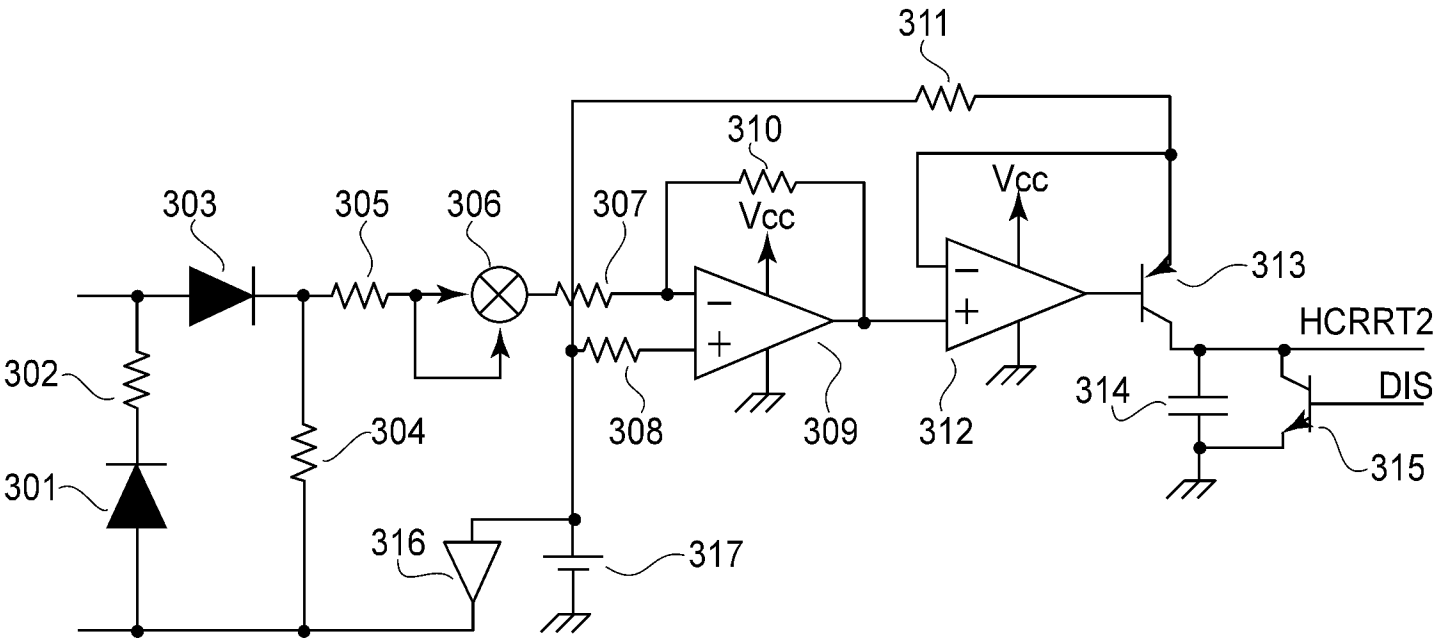

FIG. 6 is a diagram for illustrating an inlet current detecting circuit in Embodiment 1.

Figure 7:
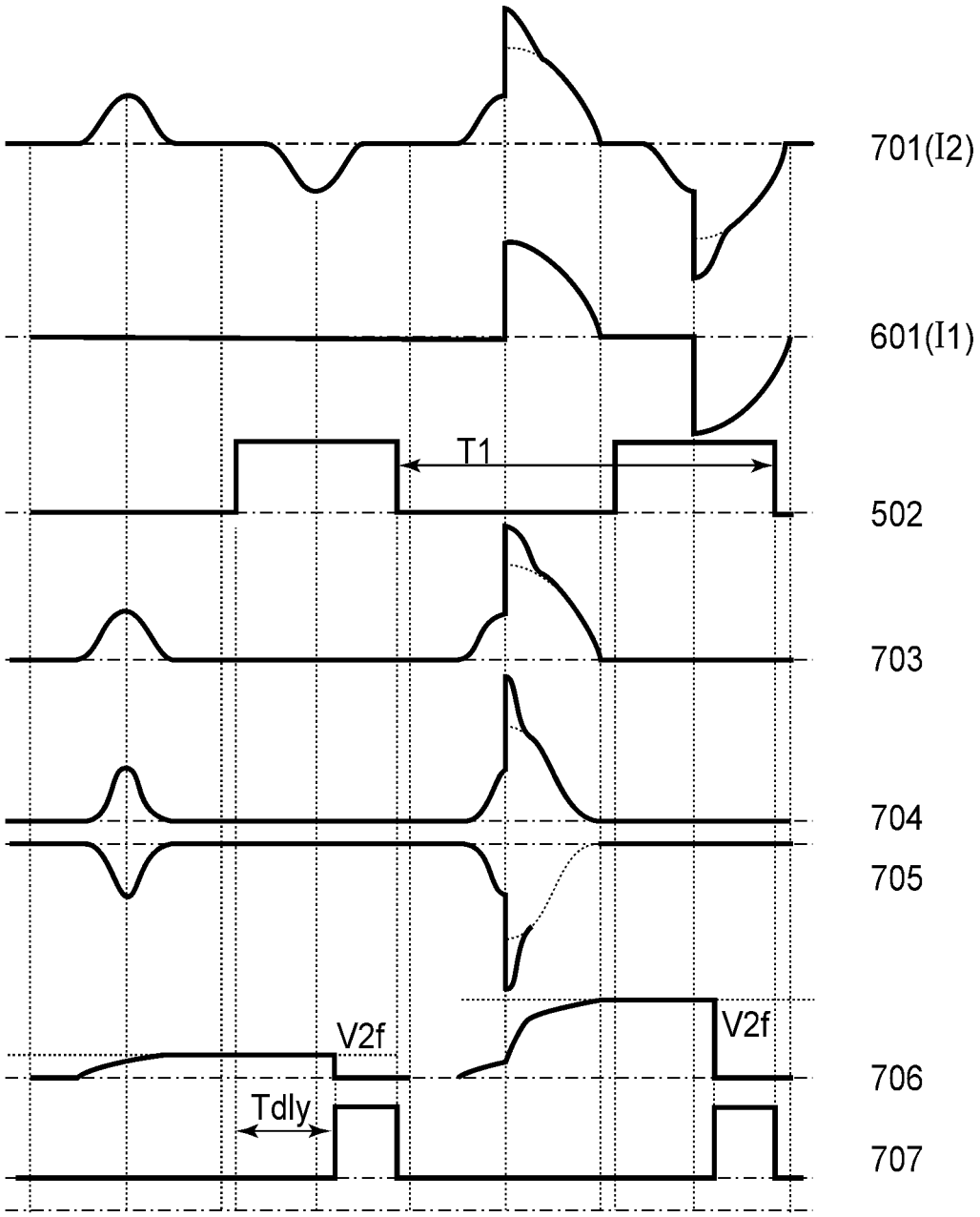

FIG. 7 is a waveform chart for illustrating an operation of the inlet current detecting circuit in Embodiment 1.

Figure 8:
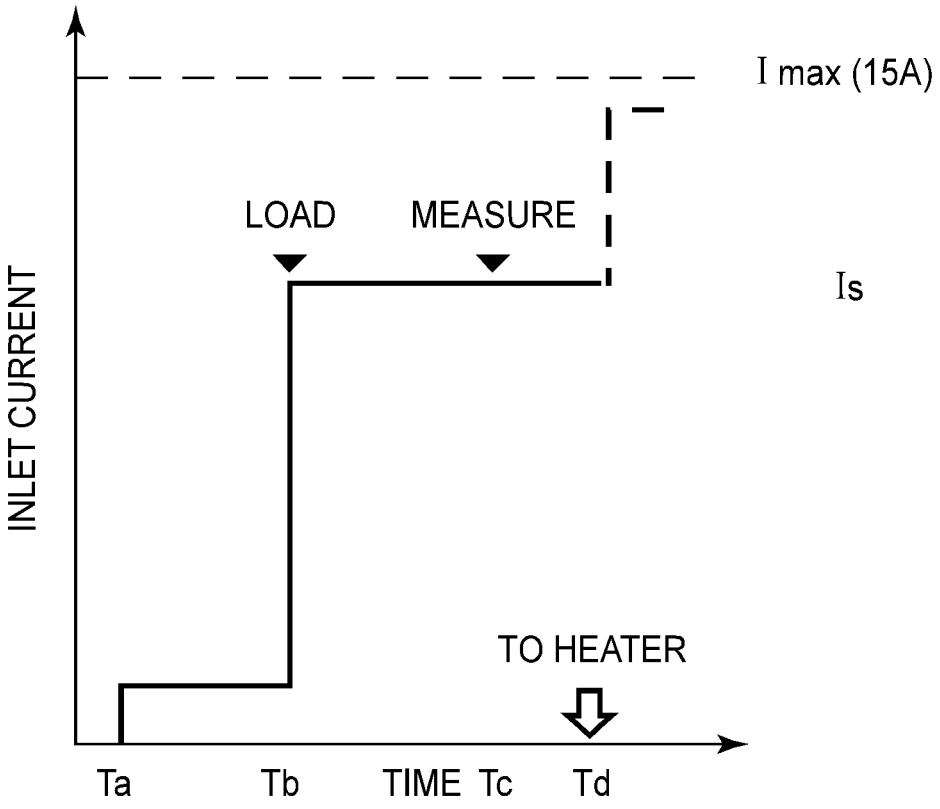

FIG. 8 is a graph for illustrating a progression of a current in Embodiment 1.

Figures 9, 10:
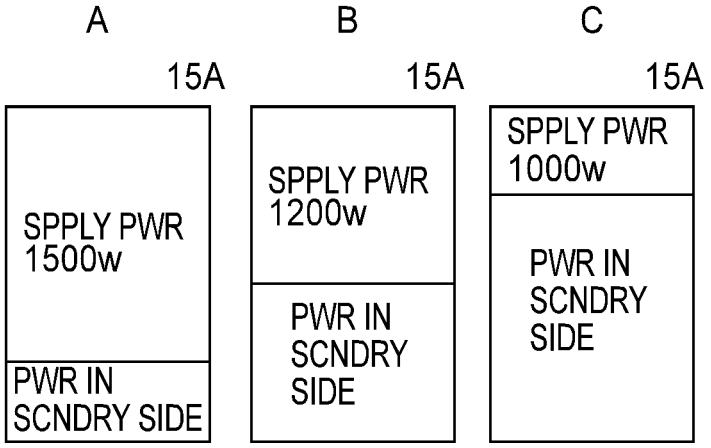

FIG. 9 is a diagram for illustrating a relationship between suppliable electric power and a fixing device rising time in Embodiment 1.

FIG. 10 is a table showing a combination of the suppliable electric power and a stand-by target temperature in Embodiment 1.

Figure 11:
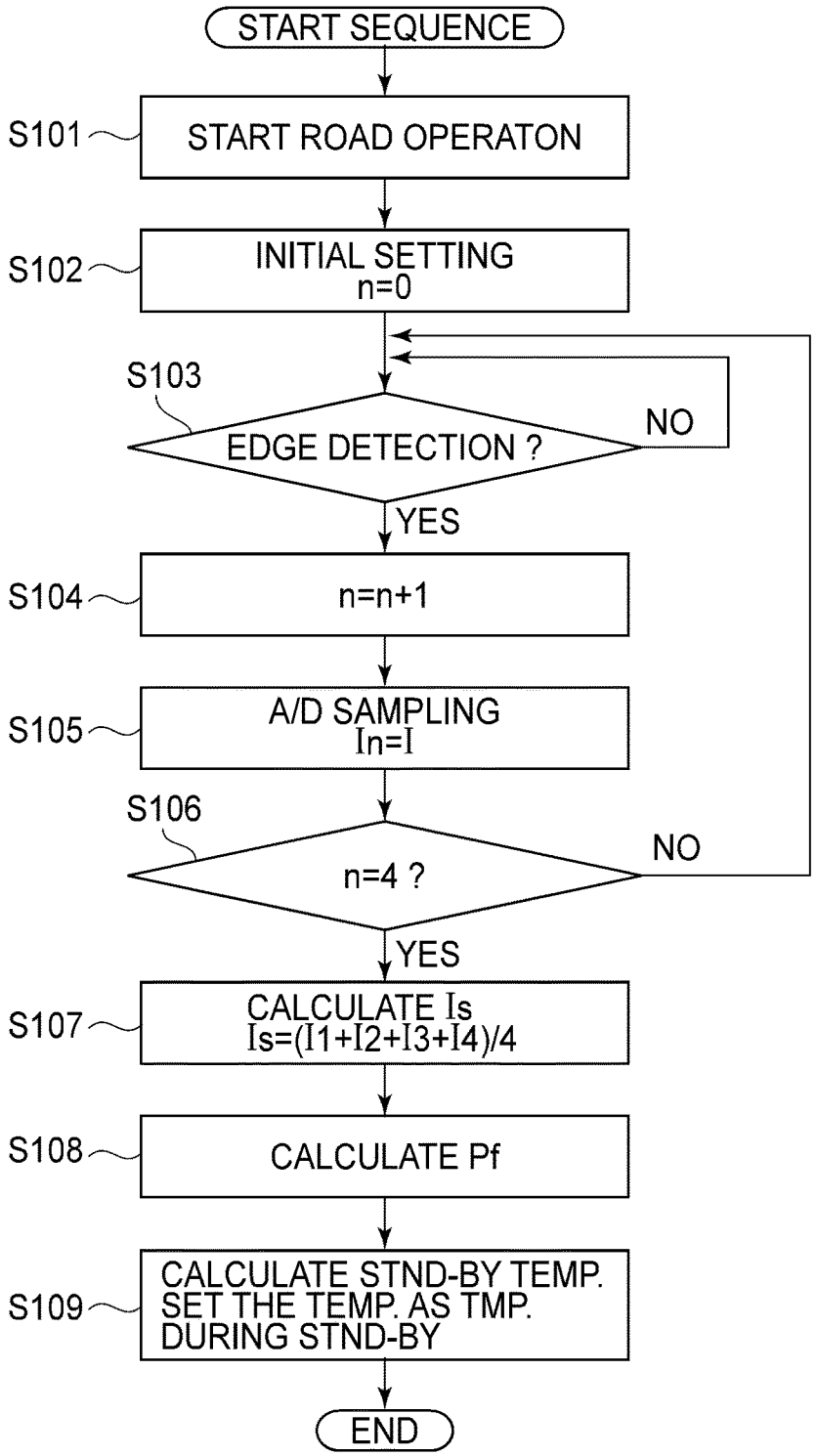

FIG. 11 is a flowchart of a stand-by target temperature determining process in Embodiment 1.

Figure 12:
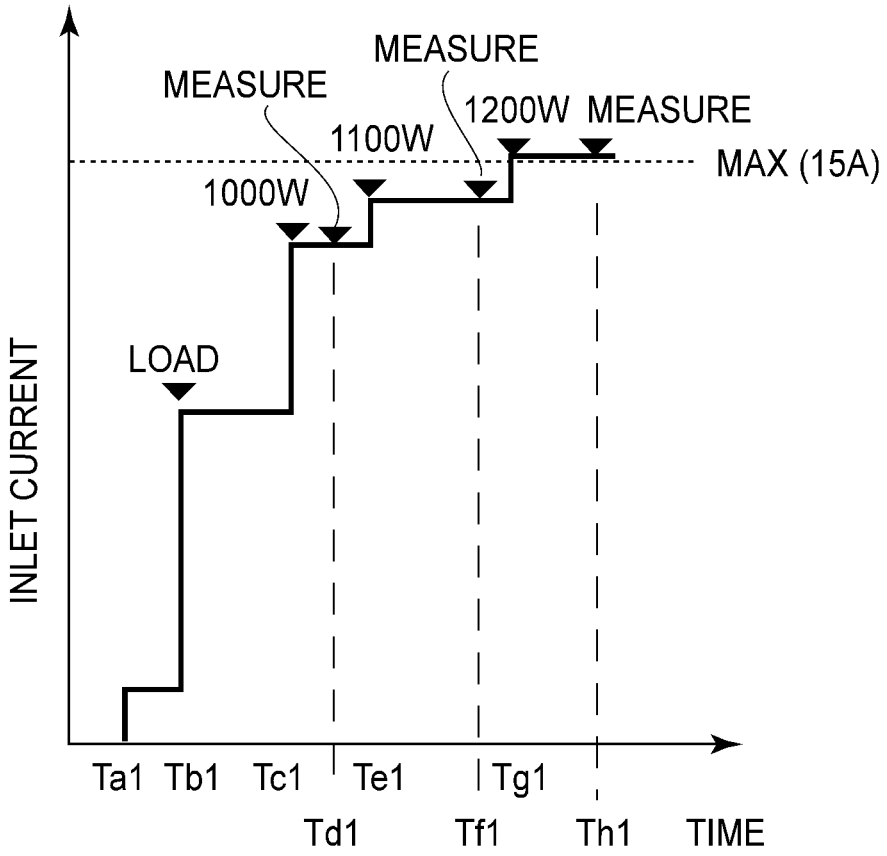

FIG. 12 is a graph for illustrating a progression of a current in Embodiment 2.

Figure 13:
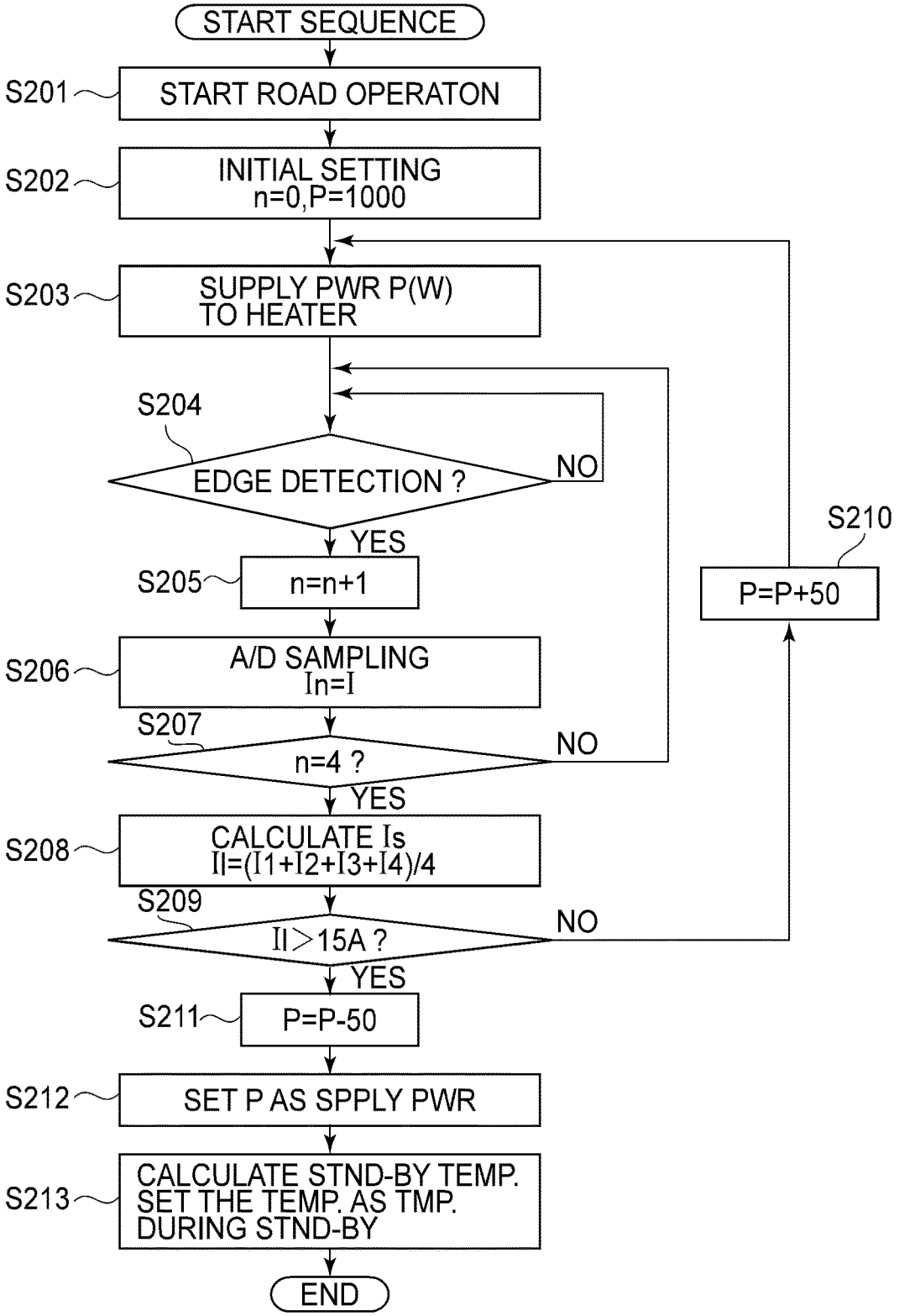

FIG. 13 is a flowchart of a stand-by target temperature determining process in Embodiment 2.

Figures 14, 15:
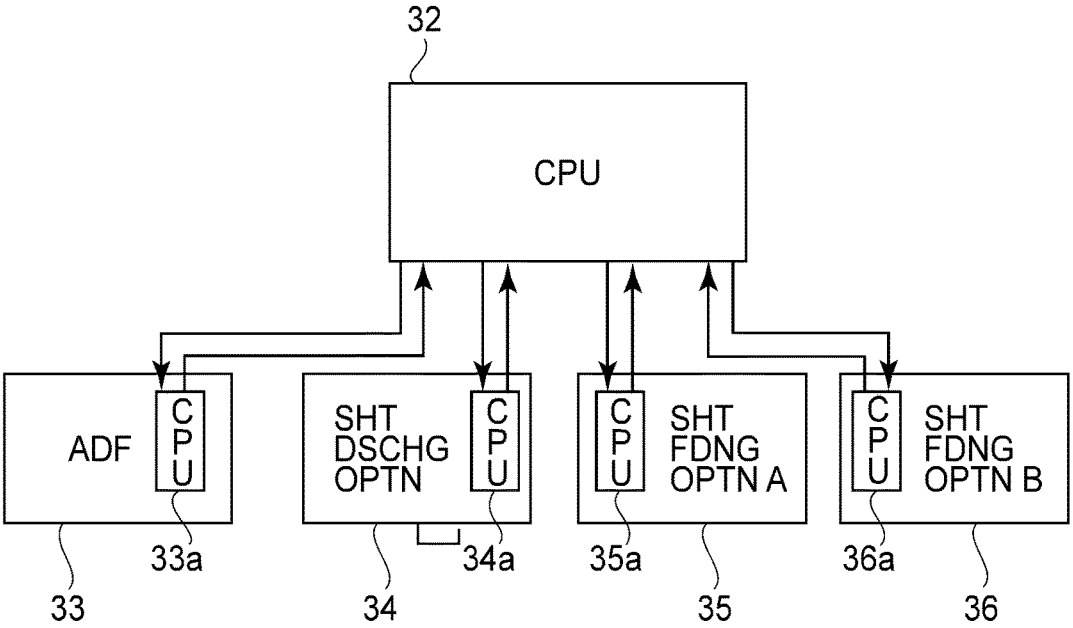

FIG. 14 is a diagram showing connection of a CPU with options in Embodiment 3.

FIG. 15 is an option power table in Embodiment 3.

Figure 16:
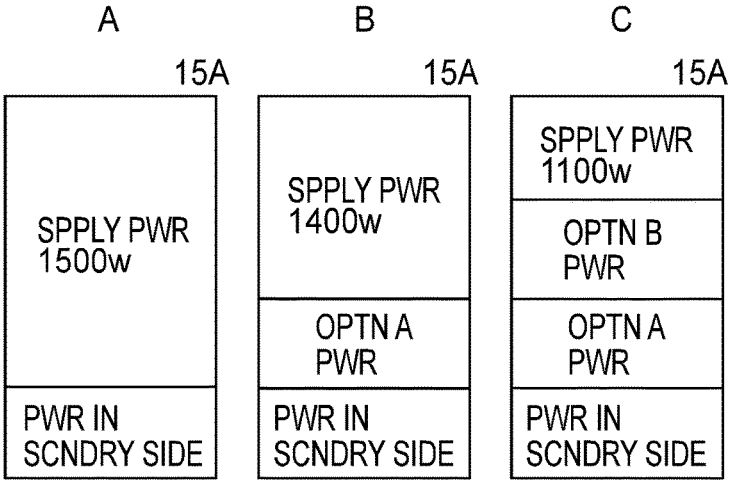

FIG. 16 is a diagram showing a relationship between suppliable electric power and a fixing device rising time in Embodiment 3.

Figure 17:
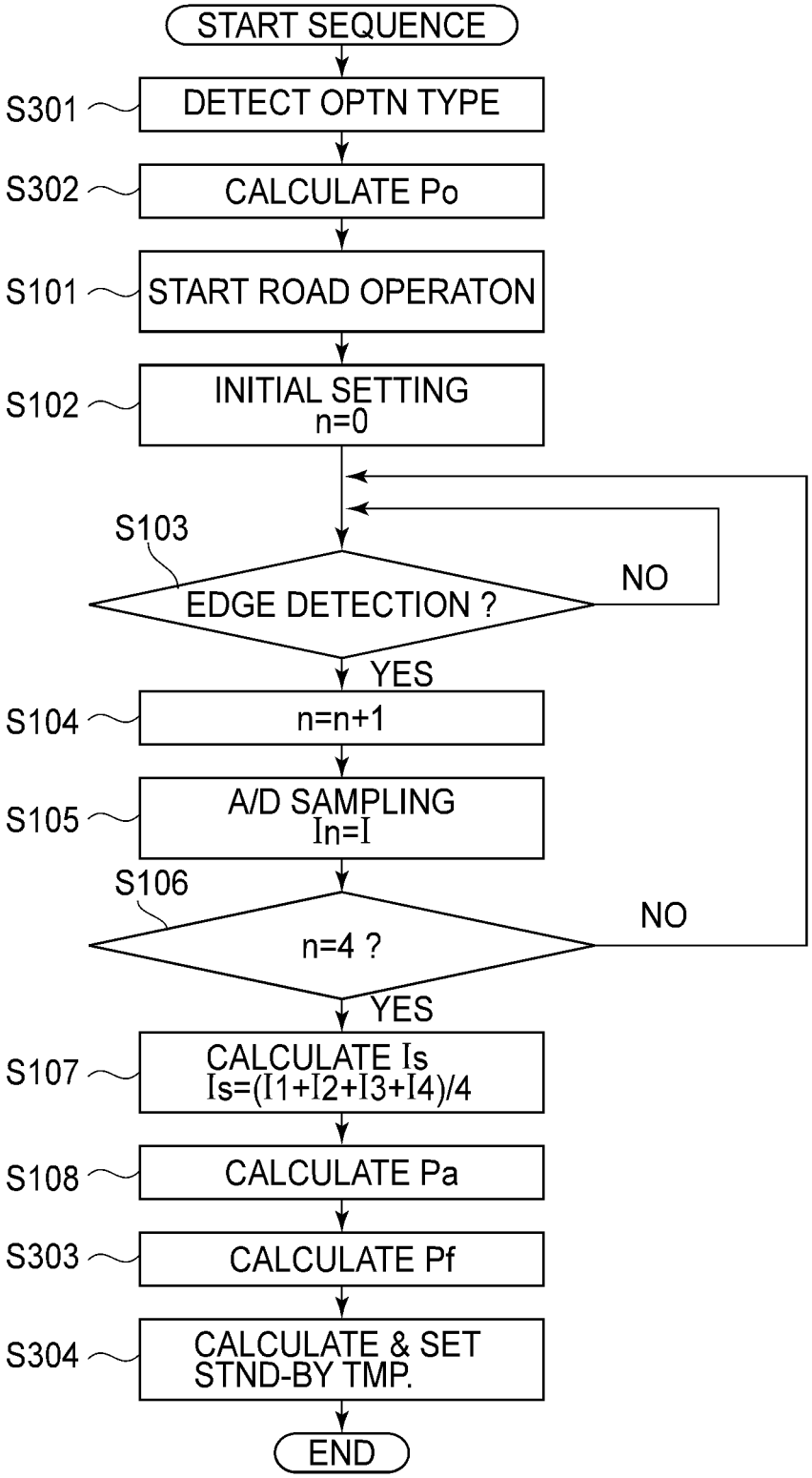

FIG. 17 is a flowchart of a stand-by target temperature determining process in Embodiment 3.

Figure 18:
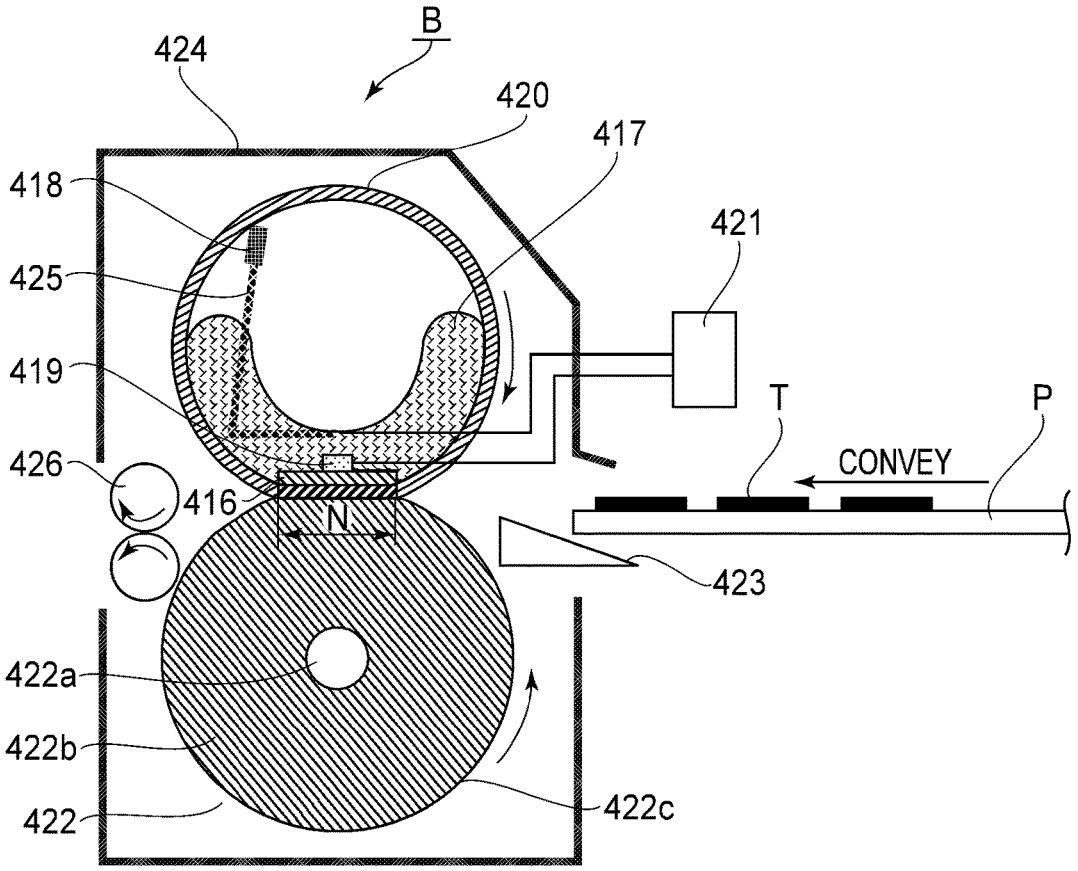

FIG. 18 is a cross-sectional view showing a general structure of a fixing device in Embodiment 4.

Figure 19:
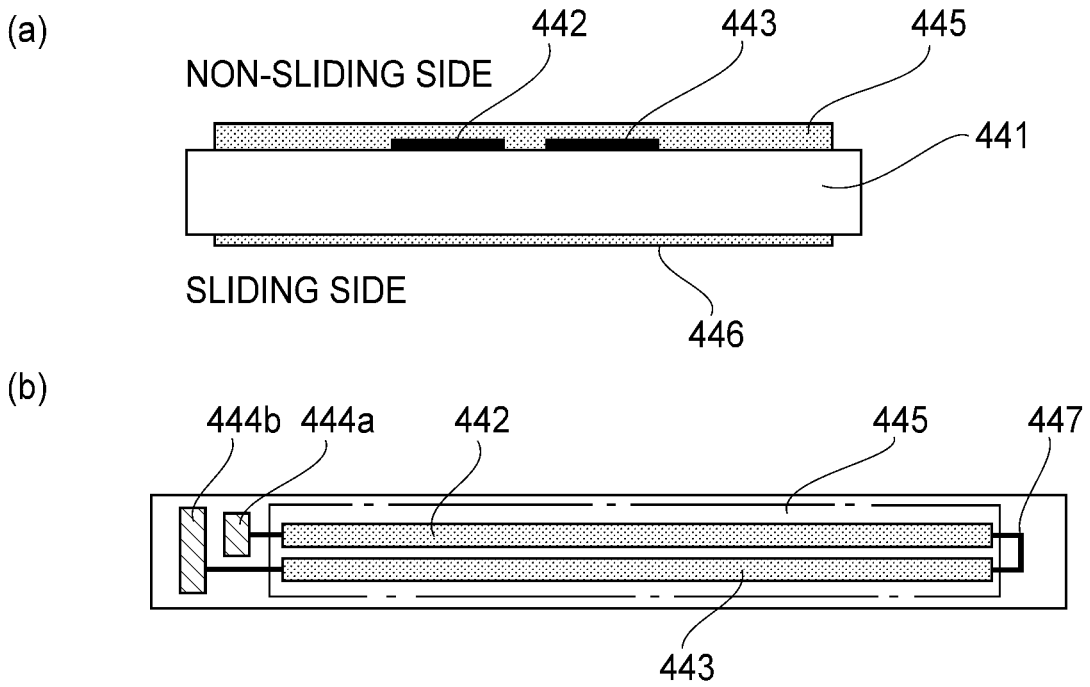

Part (a) of FIG. 19 is a cross sectional view showing a general structure of a ceramic heater in Embodiment 4, and (b) of FIG. 19 is a front view of the ceramic heater as seen from a non-sliding surface side of a fixing sleeve in Embodiment 4.

Figure 20:
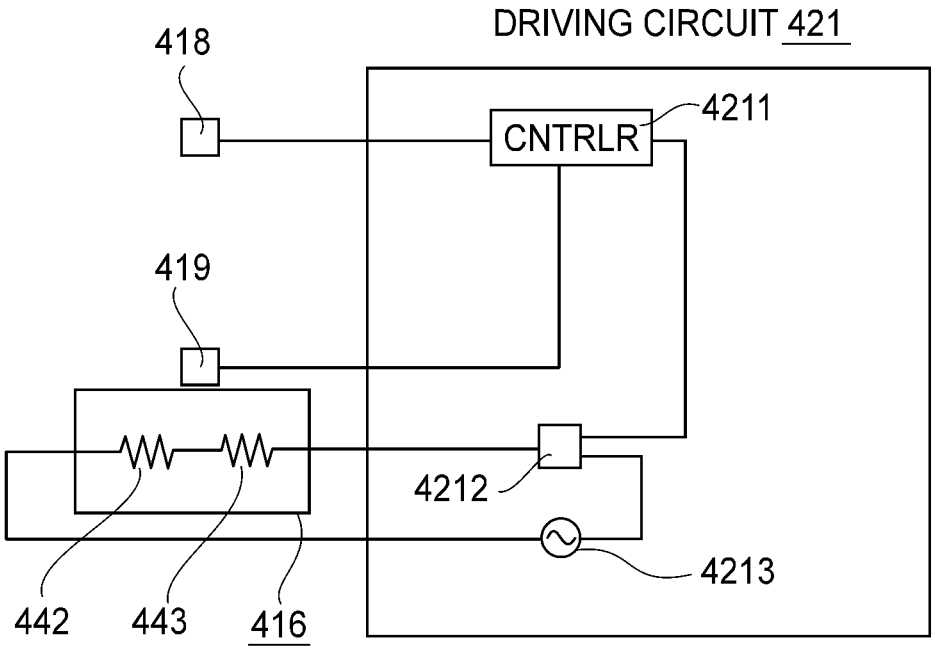

FIG. 20 is a diagram for illustrating heater drive control of the ceramic heater by a heater driving circuit in Embodiment 4.

Figure 21:
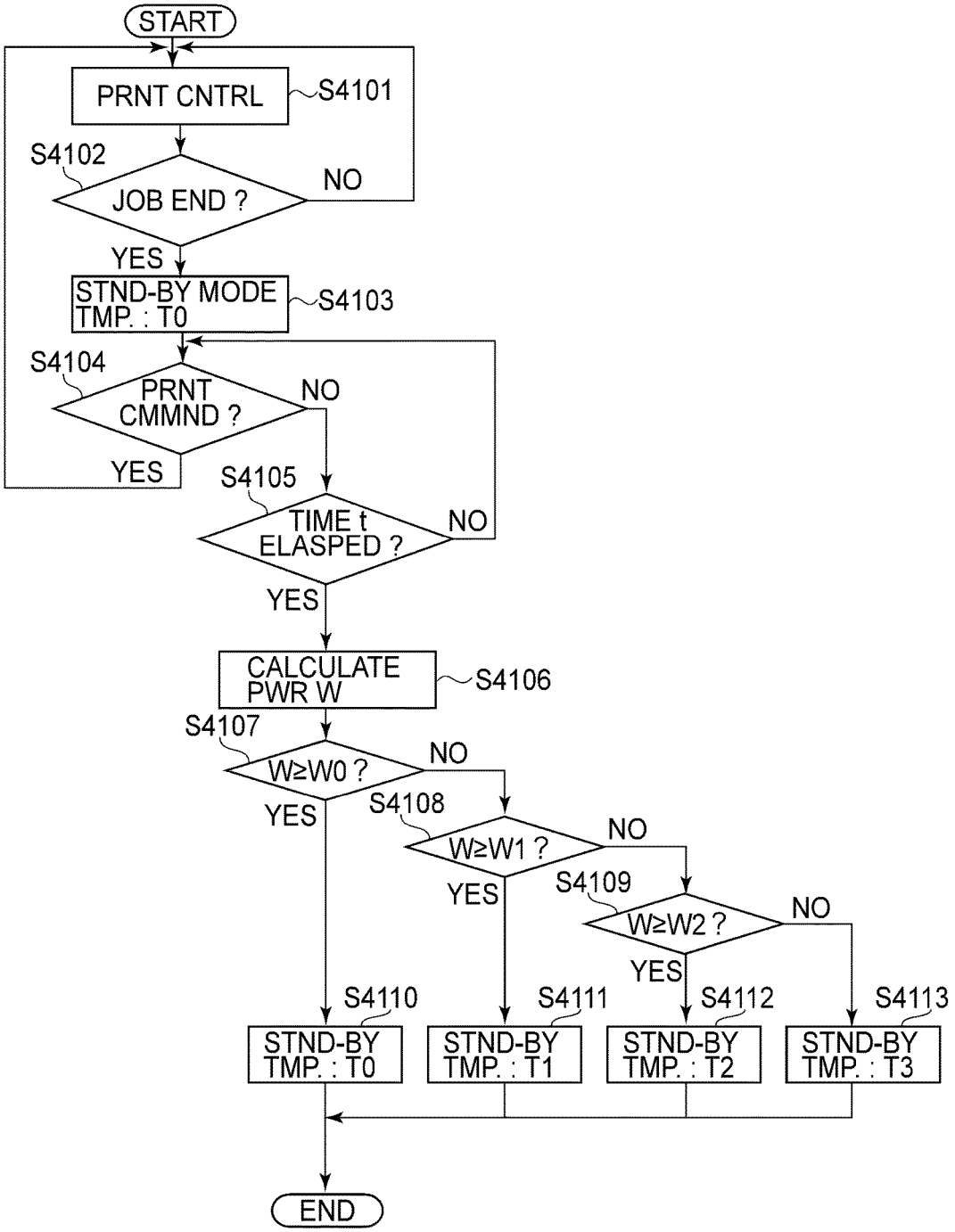

FIG. 21 is a flowchart of an operation in a fixing stand-by mode of an image forming apparatus in Embodiment 4.

Figure 22:
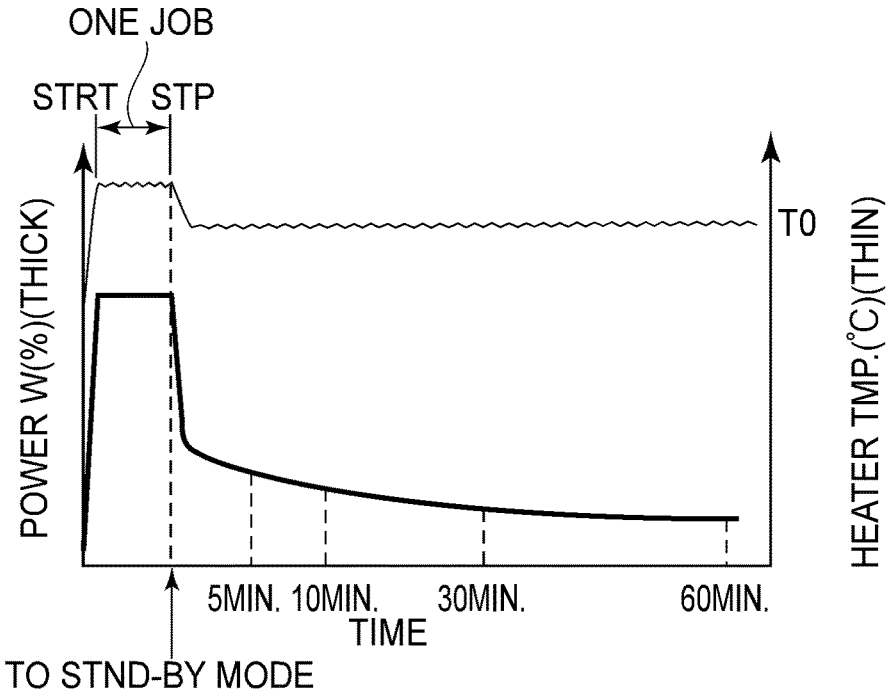

FIG. 22 is a graph showing progressions of an electric power level and a heater temperature when the operation is in the fixing stand-by control mode in Embodiment 4.

Figure 23:
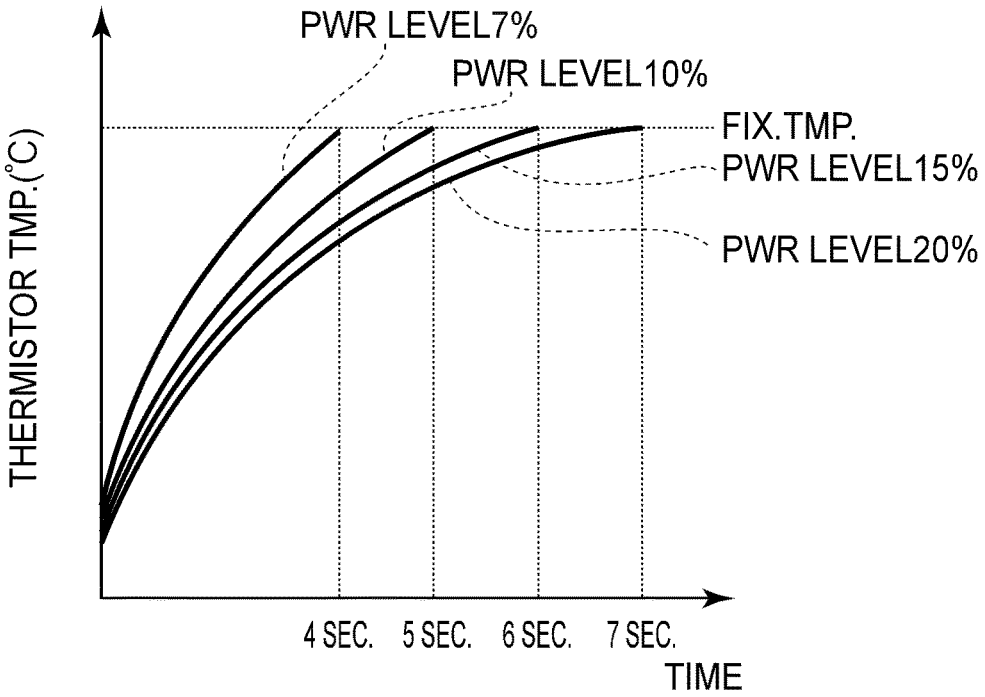

FIG. 23 is a graph showing progressions of rising of a temperature of a fixing device in the case where different electric power levels are employed in Embodiment 4.

Figure 24:
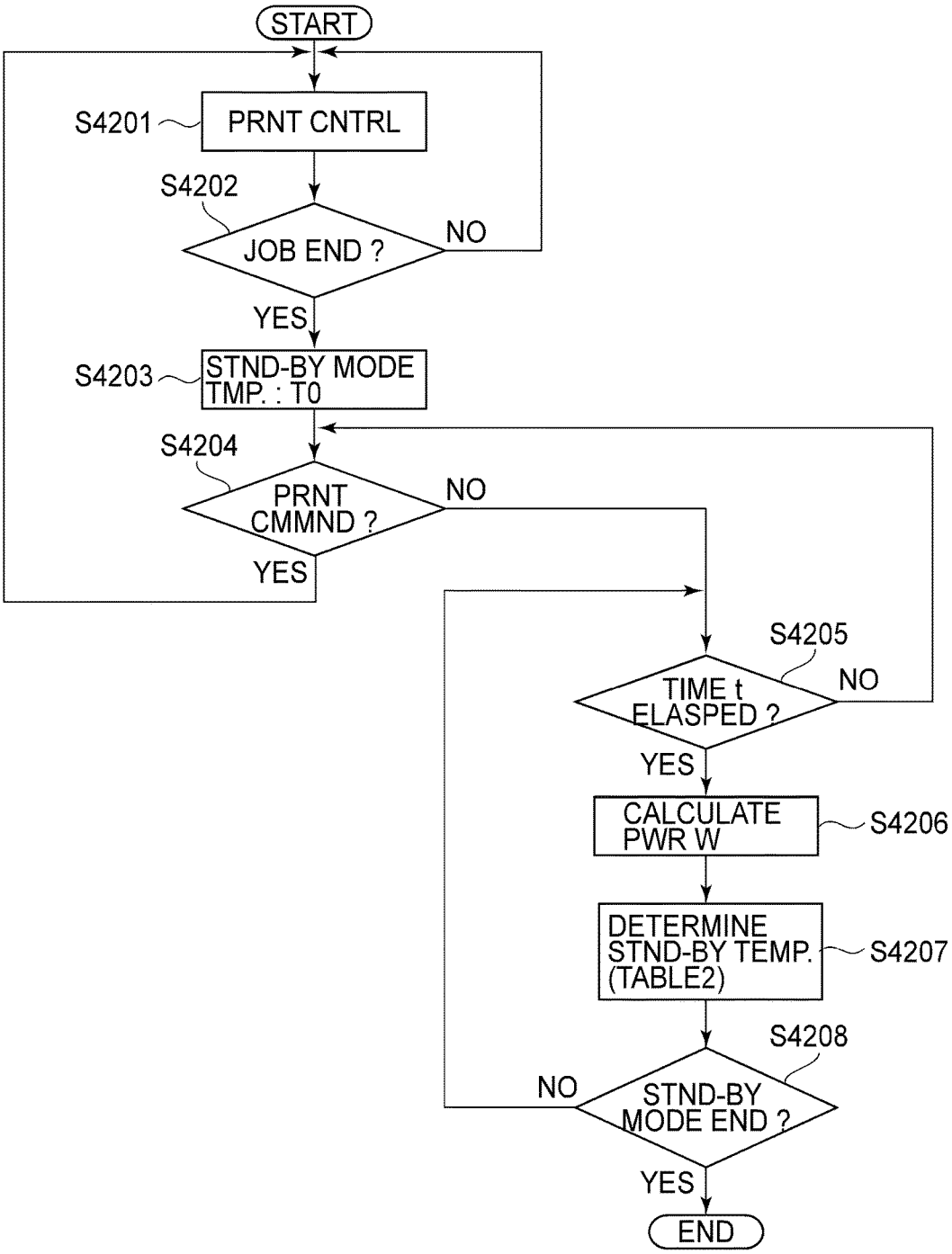

FIG. 24 is a flowchart of an operation in a fixing stand-by control mode of an image forming apparatus in Embodiment 5.

Figure 25:
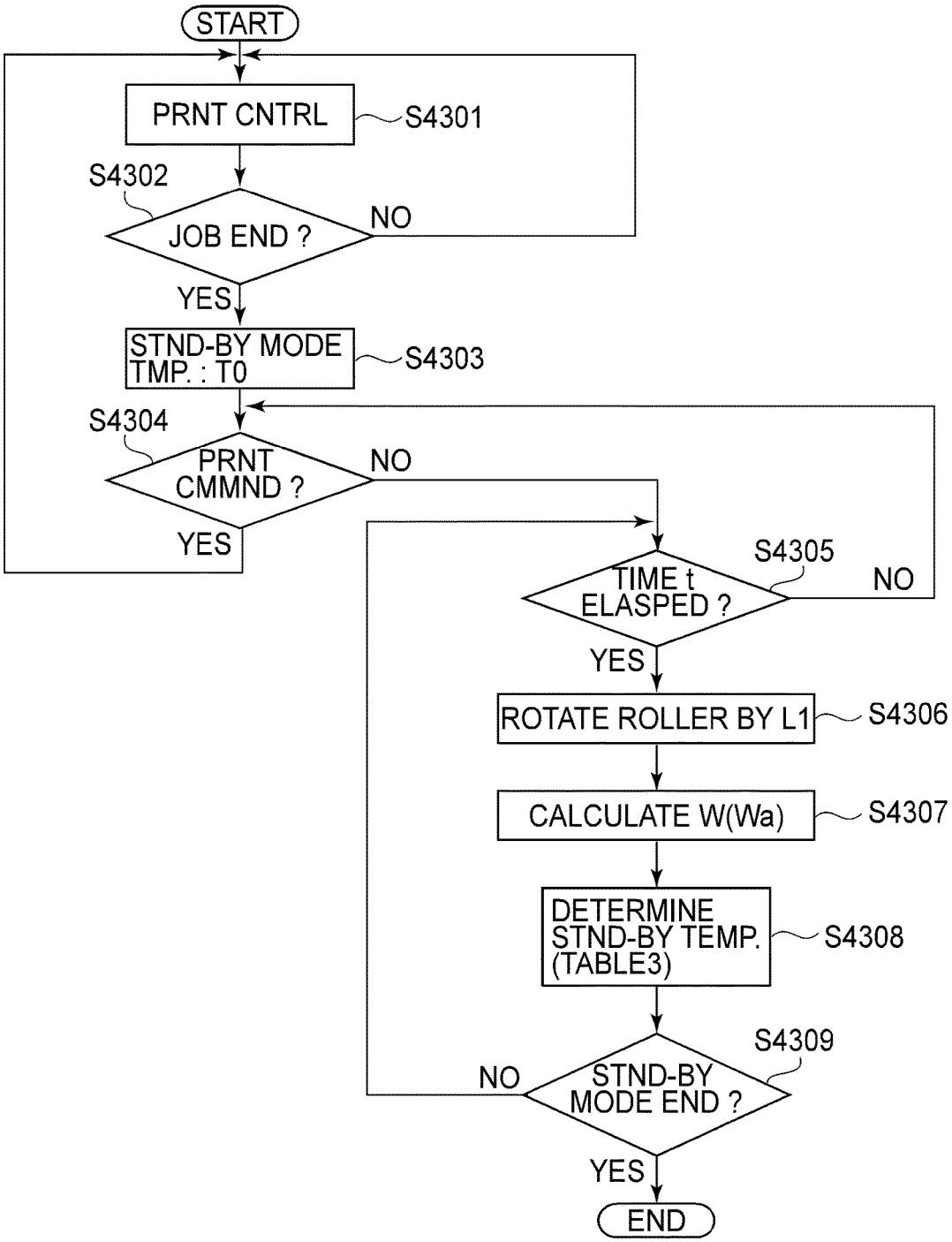

FIG. 25 is a flowchart of an operation in a fixing stand-by control mode of an image forming apparatus in Embodiment 6.

Figure 26:
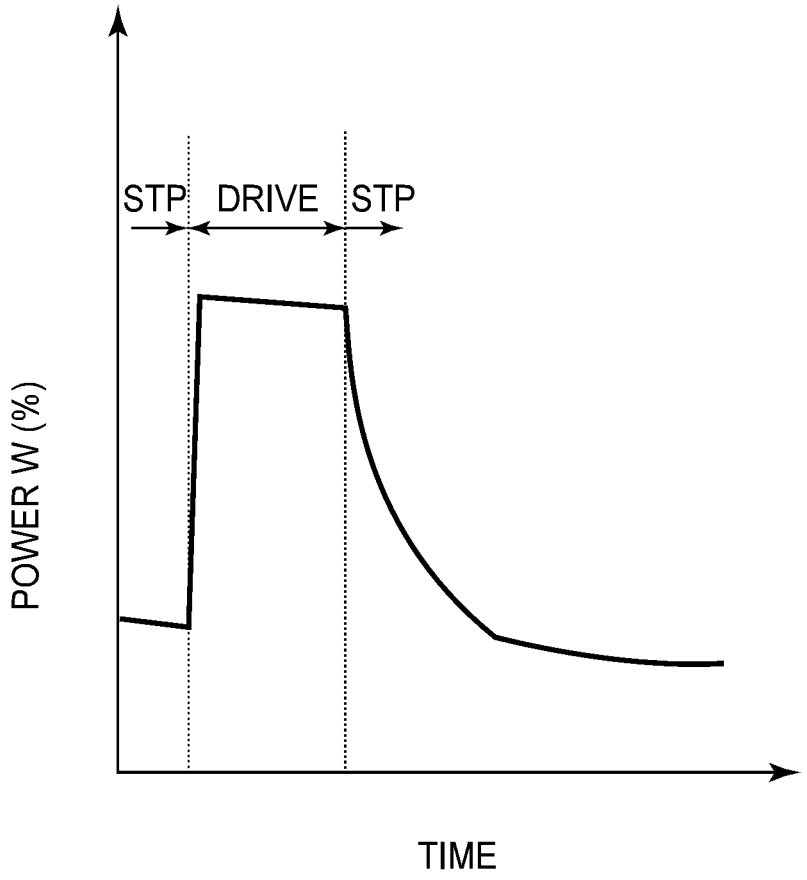

FIG. 26 is a graph showing a progression of an electric power level when a fixing sleeve and a pressing roller are rotated in the case where the operation in the fixing stand-by control mode of the image forming apparatus in Embodiment 6 is executed.

Figure 27:
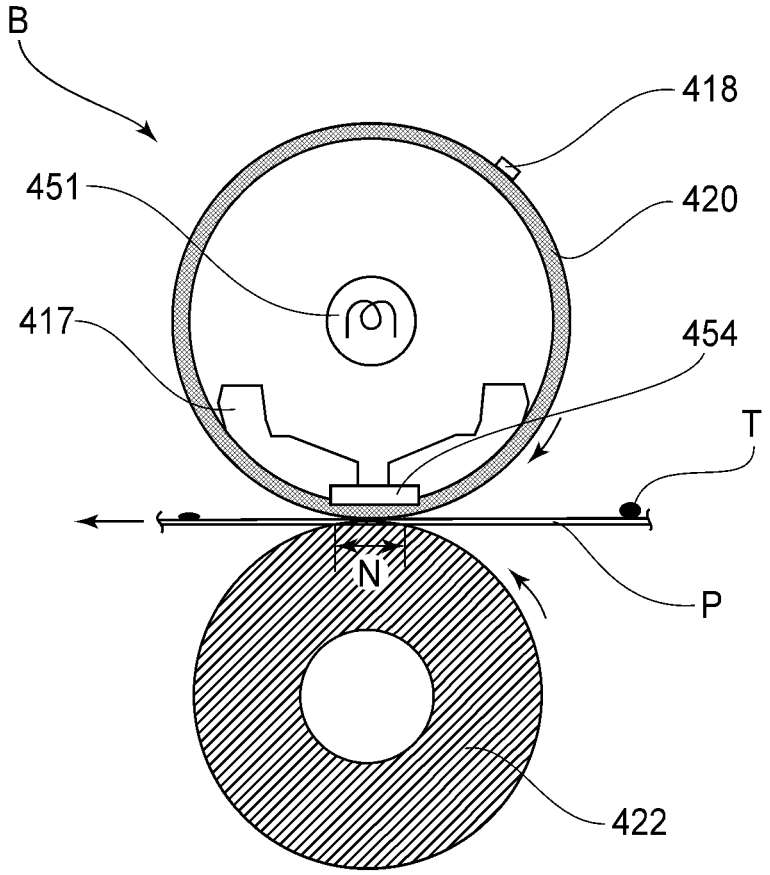

FIG. 27 is a cross-sectional view of a fixing device in another embodiment, wherein the fixing device is of a film heating type using a halogen heater.

Figure 28:
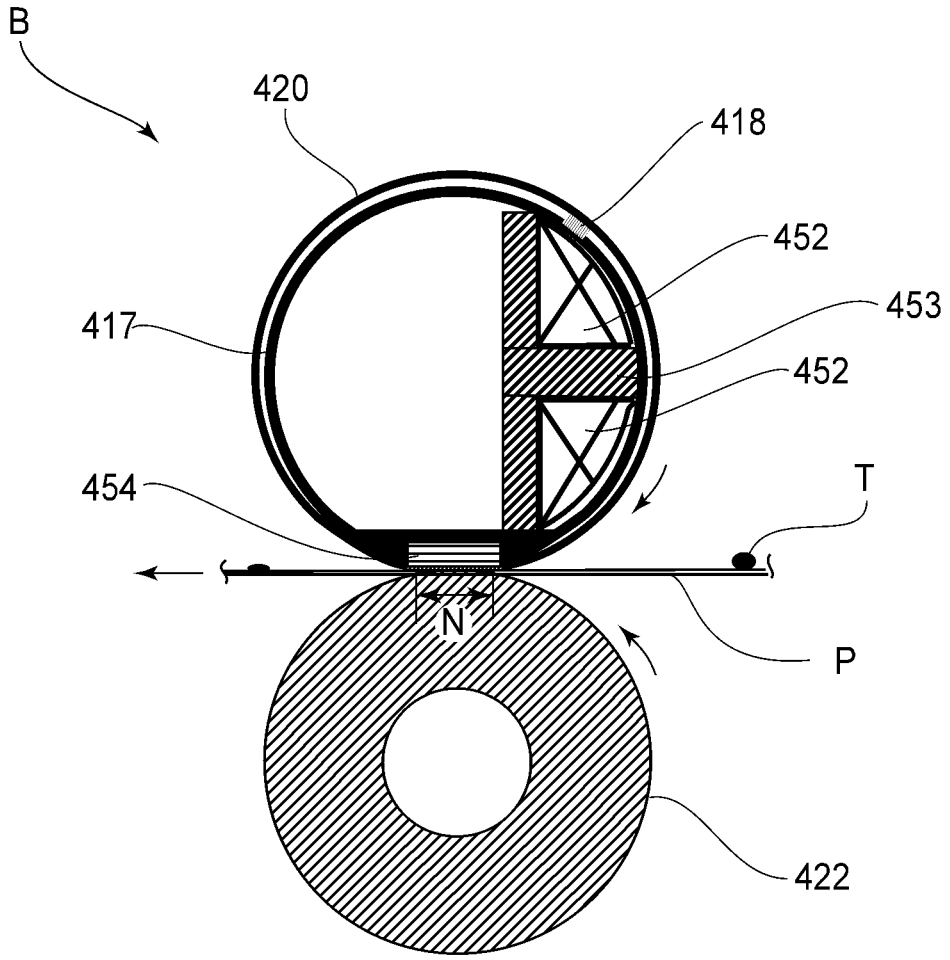

FIG. 28 is a cross-sectional view of a fixing device in another embodiment, wherein the fixing device is of a film heating type using electromagnetic induction heating.

Figure 29:
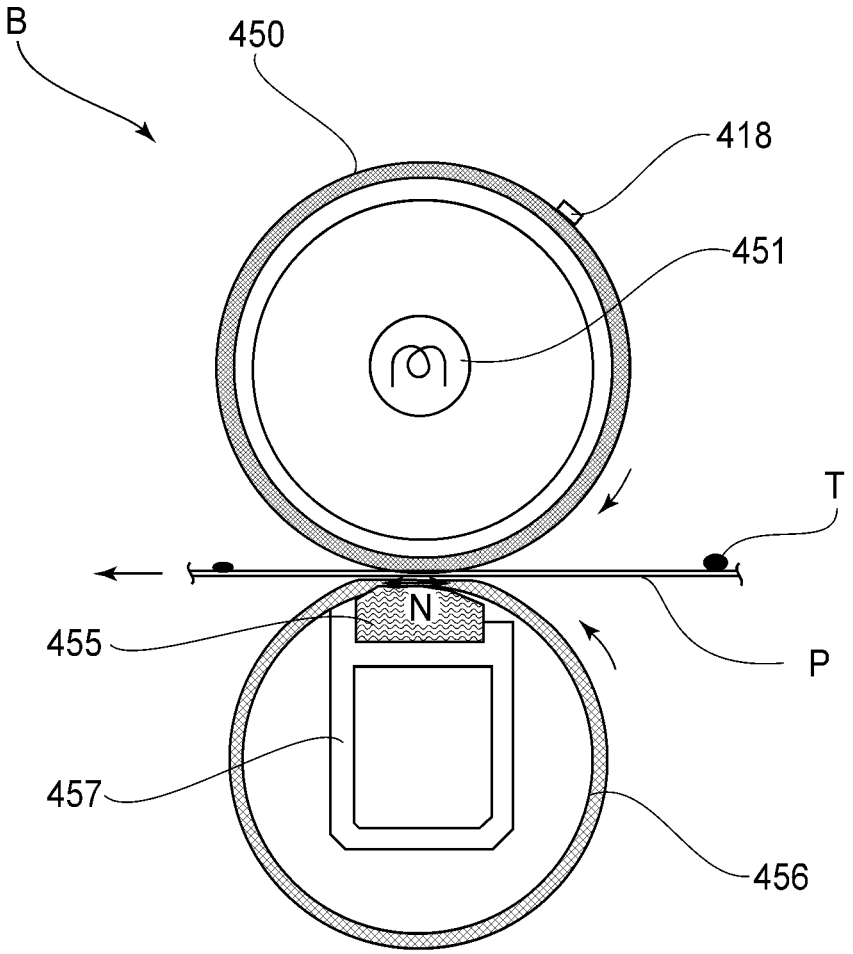

FIG. 29 is a cross-sectional view of a fixing device in another embodiment, wherein the fixing device is of a belt pressing type.

Figure 30:
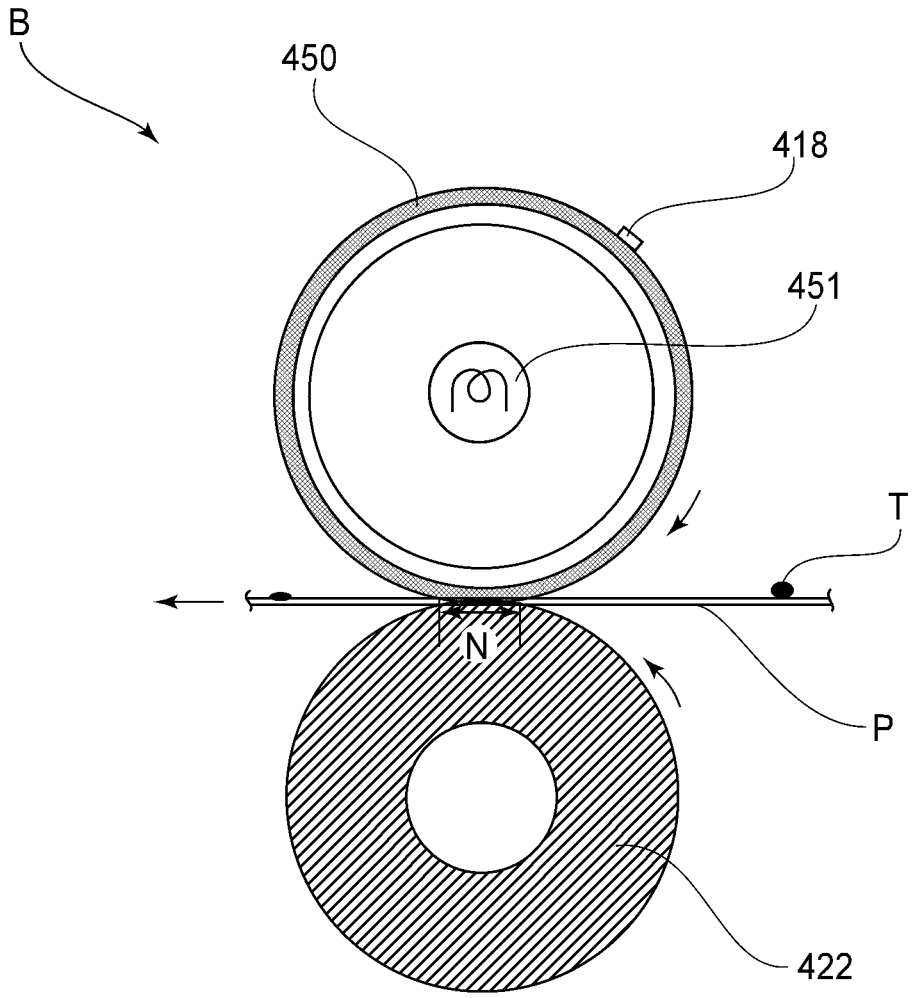

FIG. 30 is a cross-sectional view of a fixing device in another embodiment, wherein the fixing device is of a heating roller type.

DESCRIPTION OF THE PREFERRED EMBODIMENTS

With reference to the drawings, embodiments for carrying out the present invention will be specifically described below. However, dimensions, materials, shapes and relative arrangement of constituent elements described in the following embodiments should be appropriately changed depending on structure and various conditions of devices (apparatuses) to which the present invention is to be applied. That is, the scope of the present invention is not intended to be limited to the following embodiments.

Embodiment 1

<General Structure of Image Forming Apparatus>

Figure 1:
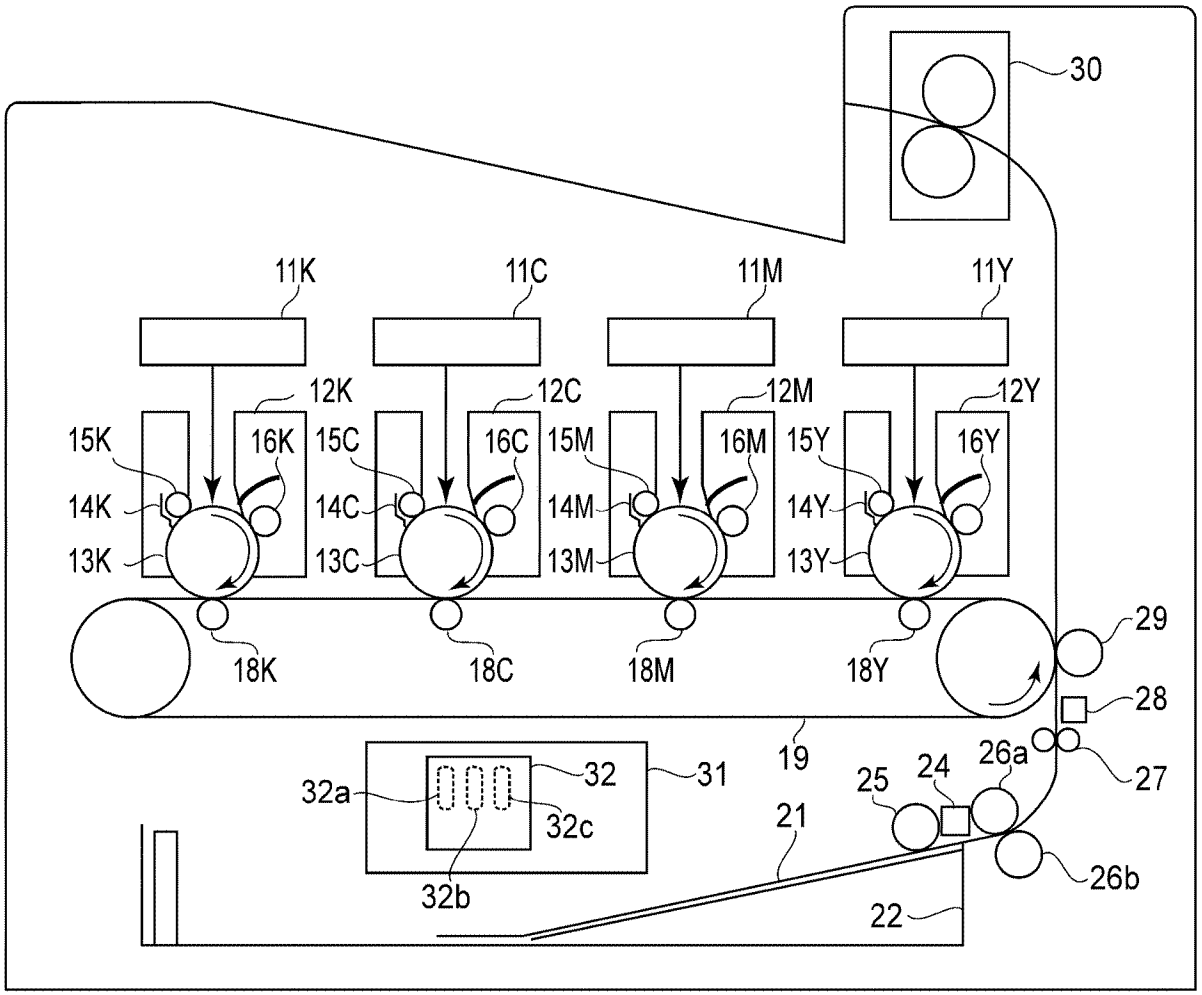
FIG. 1 is a schematic sectional view of an image forming apparatus in Embodiment 1 of the present invention.

FIG. 1 is a schematic illustration of a color image forming apparatus (laser printer) of a tandem type using an electrophotographic process in this embodiment according to the present invention. The image forming apparatus in this embodiment is constituted so that a full-color image can be outputted by superposing toner images of four colors of yellow (Y), magenta (M), cyan (C) and black (K). Further, in order to form the respective color toner images, laser scanners (11Y, 11M, 11C, 11K) and cartridges (12Y, 12M, 12C, 12K) are provided. The cartridges (12Y, 12M, 12C, 12K) include photosensitive drums (13Y, 13M, 13C, 13K) rotatable in arrow directions in FIG. 1, photosensitive member (drum) cleaners (14Y, 14M, 14C, 14K), charging rollers (15Y, 15M, 15C, 15K) and developing rollers (16Y, 16M, 16C, 16K). Further, the respective photosensitive drums (13Y, 13M, 13C, 13K) are provided in contact with an intermediary transfer belt 19, and primary transfer rollers (18Y, 18M, 18C, 18K) are provided opposed to the photosensitive drums (13Y, 13M, 13C, 13K) via the intermediary transfer belt 19.

In the neighborhood of a cassette 22 for accommodating a sheet (recording paper or a recording material) 21 as a recording medium at a sheet feeding portion, a sheet presence/absence sensor 24 for detecting the presence or absence of the sheet 21 in the cassette 22 is provided. Further, in a conveying passage, a sheet feeding roller 25, separation rollers 26*a* and 26*b* and a registration roller pair 27 are provided, and in the neighborhood of the registration roller pair 27 in a downstream side with respect to a sheet conveyance direction, a registration sensor 28 is provided. In a further downstream side of the sheet conveyance direction, a secondary transfer roller 29 is provided in contact with the intermediary transfer belt 19, and a fixing device 30 is provided downstream of the secondary transfer roller 29.

A controller 31 as a control portion of the laser printer is constituted by a CPU (central processing unit) 32 including ROM 32*a*, RAM 32*b*, a timer 31 and the like, and by various input/output control circuits (not shown) and the like.

Next, the electrophotographic process will be briefly described. In a dark place in the cartridges (12Y, 12M, 12C, 12K), surfaces of the photosensitive drums (13Y, 13M, 13C, 13K) are electrically charged uniformly by the charging rollers (15Y, 15M, 15C, 15K). Then, the surfaces of the photosensitive drums (13Y, 13M, 13C, 13K) are irradiated, by the laser scanners (11Y, 11M, 11C, 11K), with laser light modulated depending on image data. Electric charges at a portion where the photosensitive drum is irradiated with the laser light are removed, so that electrostatic latent images are formed on the surfaces of the photosensitive drums (13Y, 13M, 13C, 13K). In the developing devices, toners held in a toner layer in a certain amount on the developing rollers (16Y, 16M, 16C, 16K) by the action of blades (not shown) are deposited on the electrostatic latent images on the photosensitive drums by a developing bias. As a result, the respective color toner images are formed on the surfaces of the photosensitive drums (13Y, 13M, 13C, 13K).

The toner images formed on the photosensitive drums are attracted onto the intermediary transfer belt 19 at a nip between the intermediary transfer belt 19 and the respective photosensitive drums. Then, the CPU 32 control image formation timing at each of the cartridges (12Y, 12M, 12C, 12K) on the basis of timing depending on a belt conveyance speed, so that the respective color toner images are successively transferred onto the intermediary transfer belt 19. As a result, a full-color image is finally formed on the intermediary transfer belt 19.

On the other hand, the sheet 21 in the cassette 22 is fed by the sheet feeding roller 25, and then by the separation rollers 26*a* and 26*b*, only one sheet 21 is passed through the registration roller pair 27 and then is conveyed to the secondary transfer roller 29. At a nip between the intermediary transfer belt 19 and the secondary transfer roller 29 disposed downstream of the registration roller pair 28, the toner image is transferred from the intermediary transfer belt 19 onto the sheet 21. The above-described portions relating to the process until the toner image (developer image) is transferred onto the sheet 21 constitute an image forming portion. Finally, the toner image on the sheet 21 is heat-fixed by the fixing device 30 as a heating portion, and the sheet 21 is discharged to an outside of the image forming apparatus.

<Structure of Fixing Device>

Part (a) of FIG. 2 is a schematic sectional view of the fixing device 30 in this embodiment. The fixing device 30 is a heating device (apparatus) of a pressing roller drive type and of a film heating type using, e.g., an endless film (cylindrical film), and generally has the following structure. The fixing device 30 includes a heater 100 as a heating means, and a heater holder 101, having a semicircular trough shape, a heat-resistant property and rigidity, on which the heater 100 is fixed and held. The fixing device 30 further includes a cylindrical fixing film 102 externally fitted loosely around the heater holder 101 on which the heater 100 is mounted. The fixing device 30 includes a pressing roller 103 as a rotatable pressing member press-contacted to the fixing film 102 toward the heater 100 to form a fixing nip N between the pressing roller 103 and the fixing film 102. The fixing device 30 includes a protective element (thermo-switch) 104 provided on the surface of the heater so that a heat-sensitive surface thereof contacts the heater surface.

The pressing roller 103 is rotationally driven, by an unshown driving means, in the counterclockwise direction indicated by an arrow in (a) of FIG. 2 at a predetermined peripheral speed. By a press-contact frictional force at the fixing nip N between the outer surface of the pressing roller 103 and the fixing film 102, a rotational force of the pressing roller 103 acts on the cylindrical fixing film 102, so that the fixing 102 is placed in a state in which the fixing film 102 is rotated by rotation of the pressing roller 103. The fixing film 102 is rotated around the heater holder 101 in the clockwise direction indicated by an arrow in (a) of FIG. 2 while being slid in close contact with a downward surface of the heater 100 at an inner surface thereof.

When a temperature of the heater 100 is increased up to a control target temperature by supplying electric power to the heater 100, the heater temperature is controlled so as to be maintained at the control target temperature. In this temperature-controlled state, the sheet 21 on which an unfixed toner image T is carried is conveyed into the fixing nip N, where a toner image-carrying surface of the sheet 21 hermetically contacts the outer surface of the fixing film 102 and then is nipped and conveyed together with the fixing film 102 through the fixing nip N. In this nip-conveyance process, heat of the heater 100 is imparted to the sheet 21 via the fixing film 102, so that the unfixed toner image T on the sheet 21 is heated and pressed to be melt-fixed. The sheet 21 pressing through the fixing nip N is curvature-separated from the fixing film 103.

Part (b) of FIG. 2 is an enlarged sectional view of the heater 100. The heater 100 is a ceramic heater of a back-surface heating type. The ceramic heater 100 is constituted by an insulating substrate of a ceramic material such as SiC, AlN or $Al_2O_3$, a heat generating member 111 formed on the insulating substrate 110 by printing or the like, and a protective layer 112 for protecting the heat generating member 111. Further, there is also the case where a glass layer for improving a sliding property with the fixing film 102 is formed on a surface, of the insulating substrate 110, opposite from the surface where the heat generating member 111 is formed.

Part (c) of FIG. 2 is a plan view of the heater 100. The heat generating member 111 includes heat generating portions 111*a* and 111*b*, electrodes 111*c* and 111*d*, and an electro-conductive portion 111*e*, and electric power is supplied to the heat generating portions 111*a* and 111*b* via the electrodes 111*c* and 111*d*, so that the heat generating portions 111*a* and 111*b* generate heat. Further, the electric power supply is effected via a connector 113 for electric power supply.

<Electric Power Supplying Circuit>

FIG. 3 is a circuit diagram showing an electric power supplying circuit and a heater driving circuit in this embodiment. A commercial power source (AC power source) 50 is connected with the image forming apparatus and supplies AC electric power to the image forming apparatus via an inlet 51. A power source portion (power source unit) 53 for supplying the electric power to a secondary-side load except the heater 100 in the fixing device 30 is a power source for driving the secondary-side load, and therefore includes a transformer. The heater 100 including the heat generating member 111 is directly supplied with the electric power from the commercial power source via the transformer. That is, the heater 100 is a primary-side load. Further, the power source portion 53 is directly supplied with the electric power from the commercial power source, so that the power source portion 53 is electrically disposed in a primary side. As shown in FIG. 3, the power source portion 53 and the heater 100 are connected with the commercial power source in parallel. The electric power of the commercial power source is supplied to the heat generating member 111 via an AC filter 52 to cause the heat generating member 111 to generate heat. Further, the electric power of the commercial power source is also supplied to the power source portion 53 via the AC filter 52, so that the power source portion 53 transforms the commercial power source by the transformer provided inside the power source portion 53 to output a predetermined voltage to the secondary-side load. The CPU 32 is also used in the heater drive control and the like, and is constituted by input and output ports, the ROM 32*a*, the RAM 32*b*, and the like.

In the image forming apparatus, in the primary side of the electric power supplying circuit, a constitution in which the heat generating member 111 of the fixing device and the power source unit 53 for supplying the electric power to the secondary side are directly connected with the commercial power source to be subjected to electric power supply is employed. Further, in the secondary side of the electric power supplying circuit, a constitution in which the motor and units, to be operated during image formation, such as the motor for rotating the photosensitive drums and the intermediary transfer belt, and the lower scanners and the like are connected with the commercial power source in a non-contact manner to be subjected to the electric power supply (i.e., to be supplied with the electric power via the transformer) is employed.

The electric power to be supplied to the heat generating member 111 is adjusted by a phase control circuit (heater driving circuit) 60 to be controlled by the CPU 32. A temperature detecting element (thermistor) 54 provided on the back surface of the heater is connected with the ground atom end thereof and is connected with a resistor 55 at another end thereof. Into an analog input port AN0 of the CPU 32, a divided voltage with respect to a fixed resistor is inputted via a resistor 56. The temperature detecting element 54 has a property that a resistance value is lowered when a temperature thereof is high. The CPU 32 detects the heater temperature by converting the voltage, to be inputted into the input port AN0, into a temperature on the basis of a temperature table (not shown) preset inside the CPU 32.

On the other hand, the electric power of the AC power source 50 is inputted into a zero-cross generating circuit 56 via the AC filter 52. The zero-cross generating circuit 56 has a constitution in which a "High" level signal is outputted in the case where a commercial power source voltage is not more than a threshold voltage in the neighborhood of 0 V, and a "Low" level signal is outputted in other cases. Then, into an input port PA1 of the CPU 32, a pulse signal with a period substantially equal to a period of the commercial power source is inputted via a resistor 57. The CPU 32 detects an edge where a zero-cross signal is changed from "High" to "Low" to use the timing as phase control timing of the heater and as switching control timing of an unshown switching power source included in the power source unit 53.

The CPU 32 determines ON-timing when the phase control circuit 60 is driven on the basis of a temperature detected by the temperature detecting element 54, and then outputs a driving signal Drive 1. First, the phase control circuit 60 will be described. At heater ON-timing depending on the detected temperature, an output port PA3 becomes "High" level, so that a transistor 65 is turned on via a base resistor 58. When the transistor 65 is turned on, a photo-triac coupler 62 is turned on. Incidentally, the photo-triac coupler 62 is a device for ensuring a creepage distance between the primary side and the secondary side, and a resistor 66 is a resistor for limiting a current pressing through a light-emitting diode in the photo-triac coupler 62.

Resistors 63 and 64 are bias resistors for a triac 61, and the triac 61 is supplied with the electric power by turning on the photo-triac coupler 62. The triac 61 is an element latched, when an ON-trigger functions during the AC electric power supply, in an electric power supply state until the AC electric power supply is eliminated, so that the electric power depending on the ON-timing is to be supplied to the heater 100 (heat generating member 111).

A total current, which is the sum of a current the power source unit (power source portion) 53 and a current pressing through the heat generating member 111, inputted from the AC power source via the AC filter 52 is inputted, as a current pressing through the inlet 51, into an inlet current detecting circuit 71 via a current transformer 70. That is, the inlet current detecting circuit 71 detects a current pressing through an electric power supplying passage before the current branches off from the commercial power source into the heater 100 (heat generating member 111) and the power source portion 53. In the inlet current detecting circuit (current detecting portion) 71, the inputted current is converted into a voltage. The current detecting signal converted into the voltage is inputted into an input port PA0 of the CPU 32 via a resistor 72, and then is subjected to A/D conversion inside the CPU 32, so that the converted value is controlled as a digital value.

Similarly, the current pressing through the heat generating member 111 is inputted into a heater current detecting circuit 81 via a current transformer 80.

In the heater detecting circuit 81, the inputted current is converted into a voltage. The current detecting signal converted into the voltage is inputted into an input port PA2 of the CPU 32 via a resistor 82, and then is subjected to A/D conversion inside the CPU 32, so that the converted value is controlled as a digital value.

<Heater Current Detecting Circuit>

FIG. 4 is a block diagram for illustrating a constitution of the heater current detecting circuit 81 in this embodiment. FIG. 5 is a waveform chart for illustrating an operation of the heater current detecting circuit 81 in this embodiment.

In FIG. 5, a waveform 501 shows a current I1 pressing through the heat generating member 111 via the current transformer 80, and the current I1 is converted into a voltage in the secondary side. A resultant voltage output of the current transformer 80 is rectified by diodes 201 and 203 shown in FIG. 4. Resistors 202 and 205 are load resistors. A waveform 503 shows a waveform which is subjected to half-wave rectification by the diode 203. This voltage waveform is inputted into a multiplier 206. The multiplier 206 outputs, as shown by a waveform 504, a squared voltage waveform. The squared voltage waveform is inputted into (−) terminal of an operational amplifier 209 via a resistor 207. Into (+) terminal of the operational amplifier 209, a reference voltage 217 is inputted via a resistor 208, so that the reference voltage 217 is inverted and amplified by a feedback resistor 210. Incidentally, the operational amplifier 209 is supplied with the electric power from one of the power sources.

A waveform 505 shows a waveform inverted and amplified on the basis of the reference voltage 217. An output of the operational amplifier 209 is inputted into (+) terminal of an operational amplifier 212. The operational amplifier 212 controls a transistor 213 so that a current determined by the reference voltage 217, a voltage difference of the waveform inputted into (+) terminal thereof, and a resistor 211 is caused to flow into a capacitor 214. The capacitor 214 is charged with the current detected by the reference voltage 217, the voltage difference of the waveform inputted into (+) terminal of the operational amplifier 212, and the resistor 211.

When a half-wave rectification section by the diode 203 is ended, there is no charging current to the capacitor 214, and therefore a resultant voltage value is peak-held as shown in a waveform 506. Then, as shown in a waveform 507, a transistor 215 is turned on in a half-wave rectification period by DIS signal. As a result, the charging current of the capacitor 214 is discharged. The transistor 213 is turned on and off by the DIS signal from the CPU 32, and on the basis of ZEROX signal shown by a waveform 502, ON/OFF control of a transistor 214 is effected. The DIS signal is turned on after a lapse of a predetermined time Tdly from a rising edge of the ZEROX signal, and is turned off at the same timing as or immediately before a falling edge of the ZEROX signal. As a result, the CPU 32 is capable of controlling a current detecting operation by the current detecting circuit 81 without interfering with an electric power supply period of the heater which is the half-wave rectification period of the diode 201.

That is, a peak-holding voltage V1*f* of the capacitor 214 is an integrated value of a squared value, in a half period, of the waveform which is voltage-converted via the current transformer 80. Then, the voltage value peak-held by the capacitor 214 is sent, as HCRRT1 signal 506, from the heater current detecting circuit 81 to the CPU 32. The CPU 32 subjects the HCRRT1 signal 506, inputted from the port PA2, to A/D conversion until the lapse of the time Tdly from the rising edge of the ZEROX signal 502. The heater current subjected to the A/D conversion is a heater current value for a full wave of the commercial power source, and then the CPU 32 averages heater current values for 4 full waves of the commercial power source and calculates electric power, to be consumed by the heat generating member 111 by multiplying the average value by a coefficient prepared in advance. However, the heater current detecting method is not limited thereto.

The detected current by the heater current detecting circuit is used for the purpose of, e.g., providing an upper limit to the electric power to be supplied to the heater so that excessive electric power is not supplied to the heater. For example, in the case where a duty ratio D of the electric power, to be supplied to the heater, calculated depending on a detected temperature by the temperature detecting element 54 exceeds an upper-limit duty ratio Dmax calculated depending on an output of the heater current detecting circuit, a duty ratio of electric power actually supplied to the heater is limited to Dmax.

<Inlet Current Detecting Circuit>

FIG. 6 is a block diagram for illustrating a constitution of the inlet current detecting circuit 71 in this embodiment. FIG. 7 is a waveform chart for illustrating an operation of the inlet current detecting circuit 71 in this embodiment.

In FIG. 7, a waveform 701 shows an inlet current I2 supplied via the inlet 51 and the current transformer 70, and the inlet current I2 is converted into a voltage in the secondary side by the current transformer 70. The inlet current I2 is the sum of the current I1 (waveform 501) pressing through the heat generating member 111 and a current I3 pressing through the power source unit 53.

A resultant voltage output of the current transformer 70 is rectified by diodes 301 and 303. Resistors 302 and 305 are load resistors. A waveform 703 shows a voltage waveform which is subjected to half-wave rectification by the diode 303. This voltage waveform is inputted into a multiplier 306. A waveform 704 shows a squared voltage waveform by the multiplier 306. The squared voltage waveform is inputted into (−) terminal of an operational amplifier 309 via a resistor 307. On the other hand, into (+) terminal of the operational amplifier 309, a reference voltage 317 is inputted via a resistor 308, so that the reference voltage 317 is inverted and amplified by a feedback resistor 310. Incidentally, the operational amplifier 309 is supplied with the electric power from one of the power sources.

Thus, the waveform inverted and amplified on the basis of the reference voltage 317, i.e., an output 705 of the operational amplifier 309 is inputted into (+) terminal of an operational amplifier 312. The operational amplifier 312 controls a transistor 313 so that a current determined by the reference voltage 317, a voltage difference of the waveform inputted into (+) terminal thereof, and a resistor 311 is caused to flow into a capacitor 314. As a result, the capacitor 314 is charged with the current detected by the reference voltage 317, the voltage difference of the waveform inputted into (+) terminal of the operational amplifier 312, and the resistor 311. When a half-wave rectification section by the diode 303 is ended, there is no charging current to the capacitor 314, and therefore a resultant voltage value is peak-held as shown in a waveform 706. Here, a transistor 315 is turned on in a half-wave rectification period, so that the charging current of the capacitor 314 is discharged. A transistor 315 is turned on and off by a DIS signal from the CPU 32 shown in a waveform 707, and on the basis of ZEROX signal shown by a waveform 502, the transistor 314 is controlled. The DIS signal is turned on after a lapse of a predetermined time Tdly from a rising edge of the ZEROX signal, and is turned off at the same timing as or immediately before a falling edge of the ZEROX signal. As a result, the CPU 32 is capable of controlling a current detecting operation by the inlet current detecting circuit 71 without interfering with an electric power supply period of the heater which is the half-wave rectification period of the diode 303.

That is, a peak-holding voltage V2*f* of the capacitor 314 is an integrated value of a squared value, in a half period, of the waveform which is voltage-converted via the current transformer 70. Then, the voltage value of the capacitor 312 is sent, as HCRRT2 signal shown in a waveform 706, from the inlet current detecting circuit 81 to the CPU 32. The CPU 32 subjects the HCRRT2 signal 706, inputted from the port PA0, to A/D conversion until the lapse of the time Tdly from the rising edge of the ZEROX signal 702. The inlet current subjected to the A/D conversion is an inlet current value for a full wave of the commercial power source, and then the CPU 32 averages heater current values for 4 full waves of the commercial power source and calculates electric power, to be consumed by the entire apparatus by multiplying the average value by a coefficient prepared in advance. However, the inlet current detecting method is not limited thereto.

<Initial Operation>

Next, an initial operation during turning-on of the printer power source in this embodiment will be described. During the turning-on of the power source, there is a need to check as to whether or not the motors and units, operated during printing, such as unshown motors for rotating the photosensitive members (13Y, 13M, 13C, 13K) and the intermediary transfer belt 19, and the laser scanners (11Y, 11M, 11C, 11K) and the like are normally operated. For that purpose, after the power source is turned on, a secondary-side load including the motors, the units and the like is operated, and then whether or not they are normally operated is checked. Hereinafter, this operation is referred to as the initial operation.

<Control Target Temperature During Stand-by>

Next, a method of determining a control target temperature during stand by will be described. In this embodiment, during the initial operation after the power source is turned on, in a state in which electric power is not supplied to the heater 100 (heat generating member 111), the secondary side load required to be operated in a period in which the temperature of the fixing device is increased up to a fixable temperature, and then the inlet current is detected. Further, during the initial operation, "suppliable electric power suppliable to the heater during rising of the fixing device" is calculated, so that a control target temperature in an operation in a stand by mode is determined depending on the suppliable electric power. Incidentally, in this embodiment, the secondary side load required to be operated in the fixing device rising period refers to a secondary side load always required to be operated during the printing. For example, the secondary side load includes the motors for rotating the photosensitive members and the intermediary transfer belt and for driving the laser scanners, and the like. In this embodiment, a load, which is different depending on whether or not the load is operated during the printing, such as ADF (auto document feeder) or a sheet discharge option, and which is a load determined, by a user's operation, based on whether or not the load is used, does not include the secondary side load which is always needed during the printing.

FIG. 8 is a graph showing progression of the inlet current in a series of current measuring sequences. In FIG. 8, the inlet current progression is shown by using a time as an abscissa and the inlet current as an ordinate. First, at timing Ta, the apparatus power source is turned on. Then, at timing Tb, an operation of the secondary-side load operated during rising is started. Finally, at timing Tc after a lapse of a predetermined time from the start of the operation of the secondary-side load, the inlet current is measured. The predetermined time (Tc−Tb) is set at a time until the operation of the secondary-side load is stabilized. At timing Td after the timing Tc (after the inlet current is measured), electric power supply to the heater is started so that the heater temperature is a control target temperature during stand-by. In FIG. 8, when the electric power is supplied to the heater, as indicated by a broken line, a current obtained by adding a heater current to a secondary-side load current flows into the inlet. In the case of FIG. 8, even when the electric power supply to the heater is started, the secondary-side load continues drive thereof. However, immediately after the inlet current is measured, the heater temperature may also be increased up to a stand-by temperature by stopping the drive of the secondary-side load and then by starting the electric power supply to the heater. In this embodiment, in summary, a time period in which the electric power is not supplied to the heater and the secondary-side load is driven is provided, and during the time period, the inlet current is detected to calculate the electric power to be consumed by the secondary-side load when a temperature of the fixing device is increased from the stand-by temperature to a fixable temperature. On the basis of the electric power consumption, suppliable electric power to the heater is calculated, and further, the control target temperature during the stand-by is calculated.

By detecting the inlet current in a state in which the secondary-side load to be operated during the rising of the fixing device is operated, it is possible to measure a current Ia to be used by the secondary-side load during the fixing device rising. There is a tendency that the electric power suppliable to the heater during the fixing device rising is smaller with a larger secondary-side current necessary during the fixing device rising. Therefore, the suppliable electric power can be calculated. by using an unshown table, prepared in advance from a relationship between a supply-allowable current value Imax and a secondary-side load working current Is, showing a relationship between the secondary-side load working current Is and the suppliable electric power.

FIG. 9 is a diagram showing a relationship, in this embodiment, among the suppliable electric power, a time (rising time) required for increasing the temperature of the fixing device (heater) from a control target temperature during the stand-by mode (stand-by temperature) up to a set temperature during rising (e.g., a control target temperature during the fixing (fixing temperature)), and the control target temperature during stand-by. The set temperature during the rising may also be, other than the fixing temperature, a temperature somewhat lower than the fixing temperature or may also be a temperature when a ready signal for indicating that preparation of the fixing device is completed is sent.

Here, the rising time shown in FIG. 9 is a time required for increasing the temperature of the fixing device 30 in a stand-by state up to a target temperature (230° C.) during the fixing by supplying the electric power to the heater. For example, in the case of A, the electric power consumed by the secondary-side load during the rising is small, and thus the suppliable electric power to the heater is 1500 W. In this case, FIG. 9 shows that the fixing device temperature can be increased from the stand-by temperature to the fixing temperature in 5 sec for the stand-by temperature of 170° C., 6 sec for 140° C., 7 sec for 100° C., and 9 sec for no stand-by temperature control. In the case of B, the suppliable electric power is 1200 W, and the rising time is 7 sec for 170° C., 8 sec for 140° C., 9 sec for 100° C., and 11 sec for no stand-by temperature control. In the case of C, the electric power at the secondary-side portion is large, and thus the suppliable electric power is 1000 W. In this case, the rising time is 9 sec for 170° C., 10 sec for 140° C., 11 sec for 100° C., and 13 sec for no stand-by temperature control.

In the case where a rising target time for achieving a desired FPOT is 9.0 sec, no stand-by temperature control, the stand-by temperature of 100° C., and the stand-by temperature of 170° C. may only be selected in the case of A, the case of B and the case of C, respectively. Here, in conventional stand-by temperature control, even when the suppliable electric power is sufficient as in the case of A, the stand-by temperature is uniformly set at 170° C. so as to be the same as that in the case where the suppliable electric power is small as in the case of C. For that reason, in the case where the suppliable electric power is sufficient as in the case A, there is a possibility that the electric power is consumed wastefully by the stand-by temperature control effected more than necessary. As a fluctuation factor of the secondary-side electric power as in the cases of A to C, there is a torque fluctuation or the like due to a length of an operation (working) period of the apparatus (device). As in this embodiment, by setting the stand-by temperature depending on the suppliable electric power to the heater, the electric power consumption by the stand-by temperature control can be minimized while suppressing extension of the FPOT.

Next, with reference to FIG. 10, a method of setting the stand-by temperature from the suppliable electric power calculated by the CPU (calculating portion) 32 will be described. FIG. 10 is an example of correspondence table, between the suppliable electric power and the stand-by temperature, showing a combination capable of increasing the fixing device temperature from the control target temperature during an operation in a stand-by mode to the control target temperature during the fixing in a desired rising target time and also capable of suppressing the electric power consumption during the operation in the stand-by mode. The stand-by corresponding to the calculated suppliable electric power is selected from this table (FIG. 10) prepared in advance, and is set at the control target temperature to be set during the stand-by mode. By such a stand-by temperature setting method, it is possible to set the stand-by temperature at a high level when the suppliable electric power is small and at a low level when the suppliable electric power is large. As a result, it becomes possible to reduce the electric power during the stand-by while satisfying the desired FPOT.

FIG. 11 is a flowchart for illustrating a process for determining the stand-by target temperature in this embodiment. The CPU 32 starts, as described above with reference to FIG. 8, the operation of the secondary-side load (i.e., various loads, such as the motor for driving the photosensitive drum, connected with the secondary-side portion of the transformer provided in the power source unit 53) during, e.g., the initial operation after the power source is turned on is started (S101). Then, the CPU 32 clears a counter n in initial setting (S102), and then at timing when zero-cross rising is detected (S103), increments the counter n (S104). Then, the CPU 32 effects A/D sampling of the inlet current detecting circuit to set In=I (S105), and then effects inlet current detection corresponding to 4 full waves (4 cycles) of the commercial power source (S106). Next, the CPU 32 averages current values corresponding to the 4 full waves of the commercial power source to calculate a secondary-side working current (S107). Next, the CPU 32 calculates (selects) a suppliable electric power Pf from a secondary-side working current-suppliable electric power table prepared in advance (S108). Finally, the CPU 32 calculates (selects) the stand-by temperature from a suppliable electric power-stand-by temperature table, and then sets the stand-by temperature as a control target temperature during stand-by (S109), thus completing the stand-by temperature determining sequence.

As described above, according to this embodiment, in the apparatus for warming the fixing device (heater) during the operation in the stand-by mode in which the apparatus awaits an image forming request, depending on an electric power status of the apparatus, without sacrificing the FPOT, it is possible to reduced the electric power consumption of the image forming apparatus during the operation in the stand-by mode.

Incidentally, the control sequence and the table constitution are not limited to those in this embodiment. In this embodiment, e.g., the calculation of the suppliable electric power and the stand-by temperature is made by selecting the suppliable electric power and the stand-by temperature from the table prepared in advance, but a constitution in which the suppliable electric power and the stand-by temperature are calculated, on the basis of detected values detected by the inlet current detecting circuit, by using a predetermined operational expression may also be employed.

Embodiment 2

In Embodiment 1, during the initial operation or the like after the power source is turned on, the secondary-side load to be operated during the fixing device rising is operated in the state in which the electric power is not supplied to the fixing device, and then the current at the inlet is detected, after the operation of the secondary-side load is stabilized, to calculate the suppliable electric power. That is, in Embodiment 1, there is a need to provide a time when only the secondary-side load is operated.

An image forming apparatus according to Embodiment 2 of the present invention is characterized by start of electric power supply to the fixing device at timing before the operation of the secondary-side load is stabilized. As a result, the time required for increasing the heater temperature up to the stand-by target temperature can be shortened. In the following, a difference from Embodiment 1 will be principally described, and a common constitution will be omitted from description. Here, matters which are not described particularly are the same as those in Embodiment 1.

With reference to FIG. 12, a specific executing method of a current calculating sequence in this embodiment, i.e., a method of calculating a secondary-side working current will be described. FIG. 12 shows progression of the inlet current, wherein an abscissa represents a time and an ordinate represents the inlet current. This sequence can be carried out during the initial operation or when the fixing device temperature is increased up to the target temperature during the fixing in order to start the printing. In summary, the sequence can be carried out in a period in which the electric power is supplied to the fixing device (heater), and therefore there is an advantage such that there is need to provide a particular period for detecting the current used in the secondary-side load.

First, at timing Ta1, the apparatus power source is turned on, and at timing Tb1, an operation of the secondary-side load is started. Then, at timing Tc1, the electric power of 1000 W is supplied while monitoring a detected heater current by using the heater current detecting circuit 81 (FIG. 3). At timing Td1 after a lapse of a predetermined time, from the timing Tc1, when the operation of the secondary-side load is stabilized, the inlet current is measured by using the inlet current detecting circuit 71. Next, the measured inlet current value and an allowable supply current value of 15 A of the commercial power source are compared. In the case where the inlet current value is smaller than the allowable supply current value of 15 A, the electric power supplied to the fixing device is further increased while monitoring the heater current, in a period from timing Te1 to timing Th1, to measure the inlet current. An operation such that the measured inlet current and the allowable supply current value of 15 A is compared and the inlet current measurement is made by further increasing the electric power supplied to the fixing device is repeated until the inlet current value reaches the allowable supply current value of 15 A. At the timings Td1, Tf1 and Th1, the inlet current is detected. At the timings Te1 and Tg1, the electric power is increased. As shown in FIG. 12, at the time when the electric power of 1200 W is supplied to the fixing device, in the case where the inlet current value reaches the allowable supply current value of 15 A of the commercial power source, the suppliable electric power is 1100 W where the detected current does not exceed 15 A.

The above-described sequence can also be performed during the initial operation and when the fixing device rising during the printing is made. The inlet current detection is carried out while increasing the electric power supplied to the heater gradually every 4 full waves of the commercial power source voltage while the secondary-side load is operated and the electric power supplied to the heater is finely adjusted while detecting the heater current. Of values of the electric power supplied to the fixing device at the time immediately before an inlet current detection result exceeds the allowable supply current of the commercial power source, i.e., of values of the electric power, supplied to the fixing device, where the inlet current detection result does not exceed the allowable supply current of the commercial power source, maximum electric power is the suppliable electric power.

FIG. 13 is a flowchart for illustrating a process for determining the stand-by target temperature in this embodiment. The CPU 32 starts, as described above with reference to FIG. 12, the operation of the secondary-side load to be operated during the fixing device rising, during, e.g., the initial operation or printing after the power source is turned on is started (S201). Then, the CPU 32 clears a counter in initial setting and effects initialization of electric power P supplied to the fixing device (S202). Next, by using the heater current detecting circuit 81, the CPU 32 supplies the electric power P (W) to the heater (S203). Then, at timing when zero-cross rising is detected (S204), the CPU 32 increments the counter n (S205). Then, the CPU 32 effects A/D sampling of the inlet current detecting circuit 71 to set In=I (S206), and then effects inlet current detection corresponding to 4 full waves (4 cycles) of the electric power of the commercial power source (S207). Next, the CPU 32 averages current values corresponding to the 4 full waves of the electric power of the commercial power source to calculate the inlet current (S208). In the case where the inlet current is smaller than 15 A (S209), 50 is added to P (S210), so that the electric power supplied to the heater is increased by 50 W, and then similarly as in the steps S203 to S208, the inlet current corresponding to the 4 full waves of the electric power of the commercial power source is measured.

In the case where the inlet current reaches 15 A (S209: YES), the CPU 32 subtracts 50 from P (S211), and then determines P as the suppliable electric power (S212). Finally, the CPU 32 calculates (selects) the stand-by target temperature from the suppliable electric power-stand-by target temperature table shown in FIG. 10, and then sets the stand-by target temperature as a stand-by target temperature during stand-by (S213), thus completing the stand-by target temperature determining sequence.

As described above, according to this embodiment, without providing a particular period in which the current used in the secondary-side load is detected, it is possible to reduced the electric power consumption of the image forming apparatus during the operation in the stand-by mode. Incidentally, the control sequence and the table circuit constitution in the present invention are not limited to those in this embodiment.

Embodiment 3

In Embodiments 1 and 2, during the fixing device rising, all the loads on the secondary side are operated, and then the suppliable electric power is calculated. However, e.g., in the case where option devices such as an ADF, an image scanner, a sheet discharging option and a sheet feeding option are connected, it would be considered that it is difficult to operate all the loads in the secondary side during the fixing device rising.

For example, in the case where the calculation of the suppliable electric power is considered on the assumption that a state in which all the options connectable with the image forming apparatus main assembly are connected, the secondary-side working current-suppliable electric power table during the fixing device rising such that the suppliable electric power is decreased correspondingly to the electric power for the secondary-side load is required to be used. Then, the suppliable electric power is calculated as an excessively small value, and therefore it would be considered that the fixing device temperature is set at the stand-by temperature which is high more than necessary, so that there is a possibility that the stand-by during the stand-by is consumed wastefully.

In this embodiment, an image forming apparatus is characterized, in view of the above circumstance, in that the number and type of the options connected with the image forming apparatus are detected and on the basis of the detected number and type, the suppliable electric power is calculated. According to this embodiment, depending on a connecting status of the option device, it is possible to move effectively reduce the electric power consumption of the image forming apparatus. Incidentally, a constitution in this embodiment is basically the same as the constitution in Embodiment 1, and is only different in detection of connection with the option device and a suppliable electric power calculating method. Therefore, the same constitution will be omitted from description. Here, matters which are not particularly described are the same as those in Embodiment 1.

FIG. 14 is a block diagram showing connection of operation devices with the CPU 32 in this embodiment. With reference to FIG. 14, a connecting method of the image forming apparatus with an ADF 33, a sheet discharging option 34, a sheet feeding option A 35, and a sheet feeding option B 36 will be described. With the image forming apparatus, the ADF 33, the sheet discharging option 34, the sheet feeding option A 35 and the sheet feeding option B 36 are connected and include CPUs 33*a*, 34*a*, 35*a* and 36*a*, respectively. The CPU 32 and the CPUs 33*a*, 34*a*, 35*a* and 36*a* are connected with each other so that signals are inputtable into each other. The CPU 32 is constituted so that the CPU 32 communicate with the CPUs 33*a*, 34*a*, 35*a* and 36*a*, thus being capable of detecting the type and the number of the options. Incidentally, the constitution in this embodiment is merely an example, and therefore the option connecting method is not limited to that in the constitution in this embodiment.

FIG. 15 is a table showing the electric power during an operation of each of the options. Incidentally, the options shown in FIG. 15 are merely examples, and therefore the options in the present invention are not limited to those shown in FIG. 15. Of the options shown in FIG. 15, the option to be connected with the image forming apparatus main assembly is arbitrarily selected by a user. Accordingly, the electric power used under the option load in the apparatus main assembly varies depending on the number and the type of the connected options.

In this embodiment, the number and the type of the connected options are detected during the turning-on of the power source, and then the electric power consumed by the option load (working electric power of the option device) is calculated from an option electric power table prepared in advance as shown in FIG. 15. In this embodiment, by subtracting the electric power consumption by the option load from the suppliable electric power calculated in Embodiment 1, it is possible to calculate the suppliable electric power to the heater in a constitution in which the options are connected. For example, in the case where the ADF, the image scanner, the two sheet feeding options and the sheet discharging option are connected, the electric power consumed by the option load can be calculated as 100 W+200 W+(50 W×2)+50 W=450 W. In the case where the suppliable electric power calculated in Embodiment 1 is 1500 W, the suppliable electric power can be calculated by subtracting the calculated electric power consumed by the option load from the suppliable electric power calculated in Embodiment 1. In this case, the suppliable electric power is 1500 W−450 W=1050 W.

FIG. 16 is a table showing a diagram of the suppliable electric power depending on the option connecting state and showing a fixing device rising time in a combination of the suppliable electric power with the stand-by target temperature depending on the option connecting state.

For example, in the case of A, there is no electric power consumed by the option, and thus the suppliable electric power is 1500 W. In this case, FIG. 16 shows that the fixing device temperature can be increased in 5 sec for the stand-by temperature of 170° C., 6 sec for 140° C., 7 sec for 100° C., and 9 sec for no stand-by temperature control. In the case of B where the ADF is connected as the option, the suppliable electric power is 1400 W, and the rising time is 7 sec for 170° C., 8 sec for 140° C., 9 sec for 100° C., and 11 sec for no stand-by temperature control. In the case of C where the ADF and the image scanner are connected as the options, and thus the suppliable electric power is 1100 W. In this case, the rising time is 9 sec for 170° C., 10 sec for 140° C., 11 sec for 100° C., and 13 sec for no stand-by temperature control.

In the case where a rising target time for achieving a desired FPOT is 9.0 sec, no stand-by temperature control, the stand-by temperature of 100° C., and the stand-by temperature of 170° C. may only be selected in the case of A, the case of B and the case of C, respectively.

The stand-by target temperature corresponding to the calculated suppliable electric power is selected from the suppliable electric power-stand-by target temperature table prepared in advance as shown in FIG. 10, and is set at the stand-by target temperature. By such a stand-by target temperature setting method, it is possible to set the stand-by target temperature at a high level when the suppliable electric power is small and at a low level when the suppliable electric power is large. As a result, it becomes possible to reduce the electric power during the stand-by while satisfying the predetermined FPOT.

FIG. 11 is a flowchart for illustrating a process for determining the stand-by target temperature in this embodiment. The CPU 32 communicates with the CPUs 33*a*, 34*a*, 35*a* and 36*a* to power the type and the number of the connected options (S301). Next, the CPU 32 calculates electric power PO consumed by the option load from an option electric power table as shown in FIG. 15 (S302). Steps S101 to S108 are the same as those in the sequence shown in FIG. 11 in Embodiment 1 and therefore will be omitted from description. Next, the CPU 32 calculates a suppliable electric power Pf from the suppliable electric power, during the secondary-side operation, calculated in S108 and the electric power, consumed by the option load, calculated in S308 (S303). Finally, the CPU 32 calculates the stand-by target temperature from the suppliable electric power-stand-by target temperature table as shown in FIG. 17, and then sets the calculated stand-by target temperature as a stand-by target temperature (S304), thus completing the stand-by target temperature determining sequence.

As described above, according to this embodiment, without sacrificing the FPOT, it is possible to reduce the electric power consumption of the image forming apparatus during the operation in the stand-by mode depending on the option connecting status. In this embodiment, the CPU 32 functions as an option detecting means capable of detecting whether or not which option device of the option devices connectable with the image forming apparatus is connected with the image forming apparatus.

Incidentally, the control sequence and the table constitution in the present invention are not limited to those in this embodiment.

The above-described constitutions in Embodiments 1 and 3 can be employed in combination to the possible extent.

Embodiment 4

Next, Embodiment 4 will be described. Incidentally, in Embodiment 4 and subsequent Embodiments, depending on electric power necessary to maintain the fixing device temperature at a target temperature during an operation in a stand-by mode, the target temperature in the operation during the stand-by mode is set.

In the following description, with respect to the fixing device and members constituting the fixing device, a longitudinal direction refers to a direction perpendicular to a recording material conveyance direction in a plane of the recording material. A widthwise (short) direction refers to a direction parallel to the recording material conveyance direction in the plane of the recording material. A longitudinal width refers to a dimension with respect to the longitudinal direction. A widthwise (short) width refers to a dimension with respect to the widthwise direction.

FIG. 18 is a cross-sectional view showing a general structure of a fixing device (apparatus) B in this embodiment. The fixing device B is of a film heating type and a pressing roller driving type (tensionless type). Parts (a) and (b) of FIG. 19 are illustrations of a ceramic heater, in which (a) of FIG. 19 is a cross-sectional view showing a general structure of the ceramic heater, and (b) of FIG. 19 is a front view of the ceramic heater as seen from a non-sliding side of the fixing sleeve.

The fixing device B in this embodiment includes a ceramic heater (heating member or heat source) 416 which is a plate-like heater, a heater holder (heating member supporting member) 417, a rotatable cylindrical fixing sleeve (fixing member) 420, a pressing roller (pressing member) 422, and the like. Each of the ceramic heater 416, the heater holder 417, the fixing sleeve 420, and the pressing roller 422 is a member extending in the longitudinal direction.

The heater holder 417 is a member which has a substantially semicircular trough shape in cross section and which has a heat-resistant property and rigidity. The heater holder 417 is formed of a liquid crystal polymer having a high heat-resistant property. Further, the heater holder 417 supports the ceramic heater 416 by a groove portion formed along the longitudinal direction at a widthwise central portion thereof. The heater holder 417 also has the function of guiding the fixing sleeve 420 at an arcuate outer surface provided along the longitudinal direction thereof at each of widthwise end portions thereof. In this embodiment, as the liquid crystal polymer, "SUMIKASUPER E5204L" (trade name) manufactured by Sumitomo Chemical Co., Ltd. was used.

The ceramic heater 416 is a member prepared by forming, on an elongated substrate of ceramic, a heat generating resistor layer (heat generating resistor) which generates heat by electric power supply and is configured to generate heat by applying electric power thereto from a heater driving circuit 421 described later. The ceramic heater 416 includes the following members i) to vi):

i) an elongated ceramic substrate 441 having a longitudinal width of 370 mm, a widthwise width of 10 mm and a thickness of 0.6 mm, ii) two heat generating resistor layers 442 and 443 having a thickness of about 10 μm, a widthwise width of about 1 mm and a longitudinal width of 303 mm, wherein each heat generating resistor layer is formed by coating, along the longitudinal direction of the substrate 441 on a surface (fixing sleeve non-sliding surface), an electroconductive paste containing silver-palladium (Ag/Pd), which generates heat by current flow, in a line shape or a band shape by screen printing, iii) two electrode portions 444*a* and 444*b* formed, as an electric power supplying pattern for supplying the electric power to the two heat generating resistor layers 442 and 443, by coating a silver paste or the like on the same surface of the substrate 441 by screen printing, iv) an electroconductive portion 47 formed, as an electroconductive pattern to be electrically connected with the two heat generating resistor layers 442 and 443, by coating the silver paste or the like on the same surface of the substrate 441 by screen printing, v) a thin glass coating 445, having a thickness of about 30-100 μm, for ensuring protection and insulating property of the two heat generating resistor layers 442 and 443, and vi) a slidable layer 446 formed of polyimide or the like, on the other surface (fixing sleeve sliding surface) of the substrate, in a region where the slidable layer 446 contacts an inner peripheral surface (inner surface) of the fixing sleeve 420.

On the electrode portions 444*a* and 444*b* of the ceramic heater 416, an electric power supplying connector (not shown) is mounted. Then, the electric power is supplied to from the heater driving circuit (FIG. 20) 421 to the electric power supplying connector, so that the heat generating resistor layers 442 and 443 of the ceramic heater 416 generate heat and thus the ceramic heater 416 is quickly increased in temperature.

The fixing sleeve 420 is an endless belt member prepared by forming an elastic layer (not shown) on a cylindrical belt-like member as a support (not shown) of the fixing sleeve 420. Specifically, as the support, a metal endless belt (belt support) formed of SUS or the like in a cylindrical shape of 24 mm in inner diameter and 30 μm in thickness. Then, on an outer peripheral surface of the metal endless belt, a silicone rubber layer (elastic layer) of about 300 μm in thickness is formed. Further, on an outer peripheral surface of the silicone rubber layer, a 30 μm-thick PFA resin tube (outermost layer or parting layer) is coated.

In this embodiment, an outer diameter shape of the fixing sleeve 420 with respect to the longitudinal direction is a straight shape, but may also be a reverse crown shape in which a difference in outer diameter is provided between an end portion and a central portion.

The pressing roller 422 is prepared by forming, on an outer peripheral surface of a core metal 422*a* of stainless steel extending between shaft portions provided at longitudinal end portions of the core metal 422*a*, an about 3 mm-thick silicone rubber layer 422*b* as an elastic layer. Further, on an outer peripheral surface of the silicone rubber layer 422*b*, an about 40 μm-thick PFA resin tube is coated as a parting layer. An outer diameter of the pressing roller 422 in this embodiment was 25 mm. The pressing roller 422 is rotatably supported, at the shaft portions provided at the longitudinal end portions of the core metal 22*a*, by rear and front plates (not shown) of a device frame 424 of the fixing device B via bearings (not shown).

In the fixing device B in this embodiment, a fixing sleeve unit is formed by externally fitting the fixing sleeve 420 loosely around the heater holder 417 which supports the ceramic heater 416 so that the slidable layer 446 of the ceramic heater 416 is located in an inner surface side of the fixing sleeve 420. The fixing sleeve unit is disposed in parallel to the pressing roller 422 on the pressing roller 420 with the ceramic heater 416 side downward.

Longitudinal end portions of the heater holder 417 of the fixing sleeve unit are pressed by an unshown pressing mechanism in a direction perpendicular to a direction of generatrix of the fixing sleeve 420 at a force of 147 N (15 kgf) in one side at maximum, i.e., a total pressure of 294 N (30 kgf). The pressing force (pressure) is received by the pressing roller 422 via the fixing sleeve 420 to elastically deform the silicone rubber layer 422*b*, so that a fixing nip N having a predetermined widthwise width is formed between the outer peripheral surfaces of the fixing sleeve 420 and the pressing roller 422.

In FIG. 18, a sleeve thermistor (temperature detecting member) 418 for detecting a temperature of the fixing sleeve 420 is provided in contact with the inner surface of the fixing sleeve 420 at a heat detecting portion thereof. The sleeve thermistor 418 outputs temperature information at the inner surface of the fixing sleeve 420 to the heater driving circuit 421.

A heater thermistor (temperature detecting member) 419 for detecting a temperature of the ceramic heater 416 is provided on a surface of the ceramic heater 416 at a longitudinal central portion. The heater thermistor 419 outputs temperature information of the ceramic heater 416 to the heater driving circuit 421.

The heater driving circuit 421 is a heating member driving means for controlling electric power applied (supplied) to the heat generating resistors 442 and 443 of the ceramic heater 416. The heater driving circuit 412 includes an electric power supply controller 4211, a triac 4212, an AC power source 4213, and the like.

The electric power supply controller 4211 includes memories, such as ROM and RAM, in which various programs necessary to control an operation in a fixing stand-by control mode described later and to control the triac 4212 are stored. The electric power supply controller 4211 effects ON/OFF control on the basis of the temperature information from the sleeve thermistor 419 or the heater thermistor 419.

The triac 4212 is configured to maintain the temperature of the ceramic heater 416 or the fixing sleeve 420 at a predetermined temperature by effecting electric power adjusting control, such as phase control or wave number control of an AC voltage, on the basis of an instruction from the electric power supply controller 4211.

An entrance (inlet) guide 423 mounted on the device frame 424 and a fixing discharging roller 426 are provided. The entrance guide 423 performs the function of accurately guiding the recording material P coming out of the secondary transfer nip to the fixing nip N. The entrance guide 423 is formed of polyphenylene sulfide (PPS). The fixing discharging roller 426 performs the function of accurately guiding the recording material P coming out of the fixing nip N to the sheet discharging roller 432.

An operation of the fixing device B will be described with reference to FIG. 18.

The pressing roller 422 is rotated in an arrow direction at a predetermined peripheral speed (process speed) by rotationally driving the above-described driving motor depending on a print instruction (command). The rotation of the pressing roller 422 is transmitted to the surface of the fixing sleeve 420 by a frictional force between the surfaces of the pressing roller 422 and the fixing sleeve 420 at the fixing nip N. As a result, the fixing sleeve 420 is rotated by the rotation of the pressing roller 422 while contacting the slidable layer 446 of the ceramic heater 416 at the inner surface thereof. Onto the inner surface of the fixing sleeve 420, grease is applied, so that a sliding property between the heater holder 416 and the inner surface of the fixing sleeve 420 is ensured.

The electric power supply controller 4211 of the heater driving circuit 421 inputs the print instruction, thus turning on the triac 4212. As a result, the electric power is supplied from the AC power source 4213 to the heat generating resistor layers 442 and 443 of the ceramic heater 416 via the electric power supplying connector and the electrode portions 444*a* and 444*b*. The ceramic heater 416 is quickly increased in temperature by heat generation of the heat generating resistor layers 442 and 443 by the electric power supply from the heater driving circuit 421, thus heating the fixing sleeve 420 from the inner surface side of the fixing sleeve 420.

As described above, in printing control for heating the fixing sleeve 420 from the inner peripheral surface side by the ceramic heater 416, the electric power supply controller 4211 obtains the temperature information from the sleeve thermistor 418. Then, on the basis of the temperature information, ON/OFF timing of the temperature of the fixing sleeve 420 is switched, so that an amount of electric power supply to the heat generating resistor layers 442 and 443 is controlled so that the temperature of the fixing sleeve 420 is kept at a predetermined print temperature (hereinafter referred to as a stand-by temperature). In this embodiment, the amount of electric power supply to the heat generating resistor layers 442 and 443 is controlled by so-called phase control such that the electric power is supplied at timing corresponding to a predetermined phase angle, from a zero-cross phase, of an AC voltage waveform.

In a state in which the controller rotationally drives the motor and the electric power supply controller 4211 switches the ON/OFF timing of the triac 4212, the recording material P on which an unfixed toner image T is carried is guided into the fixing nip N corresponding to the number of sheets depending on the print instruction. The recording material P guided into the fixing nip N is nipped between the surfaces of the fixing sleeve 420 and the pressing roller 422 and is conveyed in the nipped state. In this conveyance process, the toner image on the recording material P is heated and melted by the fixing sleeve 420 and is concurrently fixed on the recording material P by receiving nip pressure at the fixing nip N.

As described above, in a print job for fixing the unfixed toner image T on the recording material P by heating, the heater driving circuit 421 obtains the temperature information from the sleeve thermistor 418. Then, on the basis of the temperature information, ON/OFF timing of the temperature of the fixing sleeve 420 is switched, so that an amount of electric power supply to the heat generating resistor layers 442 and 443 is controlled so that the temperature of the fixing sleeve 420 is kept at a predetermined fixing temperature (target temperature) higher than the stand-by temperature.

The recording material P on which the unfixed toner image T is fixed is separated from the surface of the fixing sleeve 420 and then is discharged from the fixing device B by the fixing discharging roller 426.

When the print job is ended, the rotational drive of the motor for the fixing device is once stopped, and the sequence goes to an operation in a fixing stand-by control mode. Here, the fixing stand-by control mode refers to a mode in which the electric power is supplied to the ceramic heater 416 in a print stand-by state, and the fixing sleeve 420 is caused to be placed in a stand-by state while maintaining the temperature of the fixing sleeve 420 at a predetermined stand-by control temperature.

FIG. 21 is a flowchart of the operation in the fixing stand-by control mode.

In S4101, an image formation control sequence is executed by input of the print instruction. In the fixing device B, the pressing roller 422 and the fixing sleeve 420 are rotated, and then print control for starting a print job is effected through a temperature rising step by electric power supply to the ceramic heater 416.

In S4102, whether or not the print job is ended is discriminated. In the case where the print job is not ended ("NO"), the sequence returns to S4101, and in the case where the print job is ended ("YES"), the sequence goes to S4103.

In S4103, the sequence transfers to the operation in the fixing stand-by control mode, in which the temperature of the ceramic heater 416 is controlled at a stand-by temperature T0. In the operation in the fixing stand-by control mode, rotation of the pressing roller 422 and the fixing sleeve 420 is stopped. Further, the electric power supply controller 4211 switches the ON/OFF timing of the triac 3212 on the basis of the temperature information of the heater thermistor 419, thus controlling the amount of the electric power supplied to the heat generating resistor layers 422 and 423 so as to keep the temperature of the ceramic heater 416 at the predetermined stand-by temperature T0. In this embodiment, T0=150° C. was set.

In S4104, whether or not a subsequent print job is inputted is discriminated. In the case where the subsequent print job is inputted, the sequence returns to S4101, and in the case where the subsequent print job is inputted, the sequence goes to S4105.

In S4105, whether or not a time, when the print instruction is not inputted, which has elapsed is a predetermined time t is discriminated. In the case where the predetermined time t has not passed, the sequence returns to S4104, and in the case where the predetermined time t has passed, the sequence goes to S4106. In this embodiment, the predetermined time t was set at 1 min.

In S4106, an electric power level W of the electric power applied (supplied) to the ceramic heater 416 is measured. The electric power level W is defined as an electric power supply duty (electric power ratio) (%) converted from a phase angle during the electric power level measurement when the electric power level at the time of full electric power supply to the ceramic heater 416, i.e., full-wave electric power supply is 100%. Here, an amount of electric power consumption when the full electric power supply to the ceramic heater 416 is made can be estimated by a detecting circuit (not shown) for detecting an input voltage into the image forming apparatus and a current pressing through the fixing device B and by setting of a resistance value or the like of the ceramic heater 416.

In S4107, whether or not the electric power level W is not less than a threshold value W0 of the electric power level W (electric power consumption level W0), i.e., W≥W0 is discriminated. In the case of W≥W0 ("YES"), the sequence goes to S4110, and in the case of W<W0 ("NO"), the sequence goes to S4108. In this embodiment, W0=15% was set.

In S4110, the temperature of the ceramic heater 416 is controlled at a stand-by temperature T0 (=150° C.). In S4111, the electric power supply controller 4211 switches the ON/OFF timing of the triac 4212 on the basis of the temperature information of the heater thermistor 419, thus controlling the amount of the electric power supply to the heat generating resistor layers 422 and 423 so that the temperature of the ceramic heater 416 is kept at the stand-by temperature T0.

In S4108, W≥W1 (threshold level) is discriminated. In the case of W≥W1 ("YES"), the sequence goes to S4111, and in the case of W<W1 ("NO"), the sequence goes to S4110. In this embodiment, W1=10% was set.

In S4111, the temperature of the ceramic heater 416 is controlled at a stand-by temperature T1. In S4112, the electric power supply controller 4211 switches the ON/OFF timing of the triac 4212 on the basis of the temperature information of the heater thermistor 419, thus controlling the amount of the electric power supply to the heat generating resistor layers 422 and 423 so that the temperature of the ceramic heater 416 is kept at the stand-by temperature T1. In this embodiment T1=140° C. was set.

In S4109, W≥W2 (threshold level) is discriminated. In the case of W≥W2 ("YES"), the sequence goes to S4112, and in the case of W<W2 ("NO"), the sequence goes to S4113. In this embodiment, W2=7% was set.

In S4112, the temperature of the ceramic heater 416 is controlled at a stand-by temperature T2. In S4113, the electric power supply controller 4211 switches the ON/OFF timing of the triac 4212 on the basis of the temperature information of the heater thermistor 419, thus controlling the amount of the electric power supply to the heat generating resistor layers 422 and 423 so that the temperature of the ceramic heater 416 is kept at the stand-by temperature T2. In this embodiment, T2=130° C. was set.

In S4113, the temperature of the ceramic heater 416 is controlled at a stand-by temperature T3. In S4113, the electric power supply controller 4211 switches the ON/OFF timing of the triac 4212 on the basis of the temperature information of the heater thermistor 419, thus controlling the amount of the electric power supply to the heat generating resistor layers 422 and 423 so that the temperature of the ceramic heater 416 is kept at the stand-by temperature T3. In this embodiment, T3=120° C. was set.

In S4110 to S4113, in a period until the operation in the stand-by mode is ended such that print control in a subsequent print job is started or the mode transfers to a sleeve mode as an electric power saving mode, the temperature of the ceramic heater 416 is controlled at a predetermined stand-by temperature.

As described above, in the operation of the fixing stand-by control mode, a magnitude of the electric power W of the electric power applied to the ceramic heater 416 after a lapse of the predetermined time t is discriminated (S4105 to S4109), and then the stand-by temperature is switched depending on the magnitude of the electric power level W (S4110 to S4113). In other words, in the heater temperature control process of S4105 to S4113, in the case where the operation in the fixing stand-by control mode is executed, the stand-by temperature (control temperature) of the heater is set at a value smaller, when the electric power consumption amount during execution of the power in the fixing stand-by control mode is small, than when the electric power consumption amount is large.

Further, a threshold for determining the stand-by temperature of the ceramic heater 416 when the operation in the fixing stand-by control mode is executed varies depending on the stand-by temperature of the ceramic heater 416 before the stand-by temperature of the ceramic heater 416 is determined.

Next, the reason why an energy saving property can be improved by the heater temperature control process in the operation in the fixing stand-by control mode in this embodiment without extending the FPOT which is the purpose of the present invention.

FIG. 22 is an illustration showing progression the electric power and the heater temperature when the operation in the fixing stand-by control mode is executed (hereinafter referred to as during stand-by control). Specifically, FIG. 22 shows time progression of a heater temperature Th and the electric power level W in a period in which the fixing device B starts a print job of a single sheet and performs, after the print job is ended, the operation in the fixing stand-by control mode, and then is left standing at a certain stand-by temperature T0 (150° C.). The above-described normal temperature state is also referred to as a cold state.

According to FIG. 22, it is understood that the electric power level W is lower with a large degree of a lapse of time from the transfer to the operation in the fixing stand-by control mode. This is because respective members of the fixing device B are gradually warmed by heat provided to the ceramic heater 416 in the operation in the fixing stand-by control mode. As a result, heat dissipation from the ceramic heater 416 to other members is less, and therefore the electric power for keeping the stand-by temperature at T0 may only be required to be lower with a larger degree of the lapse of the time.

Embodiment 4 is not limited to this example, but it is possible to discriminate a degree of warming of the fixing device B by measuring the electric power level W in the operation in the fixing stand-by control mode after an arbitrary print job. For example, after a print job in a large volume is carried out, the fixing device B is sufficiently warmed. This state is hereinafter referred to as a hot state. In the hot state, the electric power level W in the case where the sequence is transferred to the operation in the fixing stand-by control mode, a low value is measured from immediately after the transfer to the operation in the fixing stand-by control mode. Further, the electric power level W in the case where the sequence is transferred to the operation in the fixing stand-by control mode progresses at a value which is less than the electric power level (FIG. 22) in the cold state during stand-by control.

Next, with reference to FIG. 23, temperature rising progression of the fixing device B in the case where electric power levels are different when the stand-by temperature T0 is fixed (T0=150° C.) will be described. Here, a temperature rising time of the fixing device B is defined as a time from input of a print instruction of a print job until the temperature detected by the sleeve thermistor 418 reaches a predetermined fixable temperature.

According to FIG. 23, the temperature rising time in the print job in which the electric power level W is 20% is 7 sec, whereas the temperature rising time is shorter with a longer continuation time of the operation in the fixing stand-by control mode such that the temperature rising time is 5 sec for the electric power level W of 15%, 5 sec for the electric power level W of 10%, and 4 sec for the electric power level W of 7%. This shows that the fixing device temperature more easily reaches the fixable temperature with a larger degree of heat accumulation of the respective members of the fixing device B.

This means that in a heat accumulation state of the fixing device B, the stand-by temperature in the case of the transfer to the operation in the fixing stand-by control mode can be lowered from T0. In the image forming apparatus in this embodiment, when the fixing temperature rising time from the input of the print instruction is 7 sec or less, the FPOT of 9 sec can be achieved, and therefore the stand-by control temperature can be determined within a range in which 7 sec or less as the temperature rising time of the fixing device B can be satisfied. Here, the stand-by control temperature refers to a stand-by temperature determined depending on the electric power consumption amount of the ceramic heater 416.

In the case where the electric power levels W are different, the temperature rising time when the stand-by control temperature T0 is constant and the stand-by control temperature necessary to satisfy the temperature rising time of 7 sec are summarized in Table 1.

TABLE 1

| | | | | |
|---|---|---|---|---|
| EPL*[1] | 20% | 15% | 10% | 7% |
| TRT*[2] | 7 sec | 6 sec | 5 sec | 4 sec |
| SBT*[3] | 150° C. | 140° C. | 130° C. | 120° C. |

*[1]"EPL" represents the electric power level W (%) when the stand-by temperature is fixed at 150° C.
*[2]"TRT" represents the temperature rising time (sec) when the stand-by temperature is fixed at 150° C.
*[3]"SBT" represents the stand-by temperature (° C.) satisfying the temperature rising time of 7 sec.

According to Table 1, e.g., of the electric power level during stand-by control is 15% or less, the temperature rising time of 7 sec or less can be satisfied even when the stand-by control temperature is changed and set at 140° C. Similarly, by setting the stand-by control temperature at 130° C. for the electric power level of 10% or less and 120° C. for the electric power level of 7% or less, the temperature rising time is not required to be extended. That is, it is possible to detect the degree of warming of the fixing device B by measuring the electric power consumption during stand-by control. Accordingly, in the case where the fixing device B is in the hot state, it is possible to suppress the electric power level during stand-by control by accurately detecting the degree of warming and then by lowering the set temperature, and therefore the energy saving property during stand-by control can be improved.

As described above, in the image forming apparatus in this embodiment, during stand-by control, the electric power level W is measured and then the stand-by control temperature is switched depending on the magnitude of the measured electric power level. As a result, without extending the temperature rising time of the fixing device B, the energy saving property during stand-by control can be improved.

Accordingly, it is possible to improve the energy saving property without extending the time (FPOT) from the input of the print instruction until an image on the first sheet is outputted. Further, during stand-by control, a temperature load on the fixing device B can be reduced compared with that on a conventional fixing device, and therefore a durability lifetime of the fixing device B can be improved.

Embodiment 5

An image forming apparatus in this embodiment is the same in constitution as the image forming apparatus in Embodiment 4 except that an operation in a fixing stand-by control mode is different from that in Embodiment 4.

The image forming apparatus in this embodiment is characterized in that during stand-by control, resetting of the stand-by control temperature is made periodically, and at that time, the threshold of the electric power level for determining the stand-by control temperature is switched every stand-by temperature level.

FIG. 24 is a flowchart of an operation in a fixing stand-by control mode of the image forming apparatus in this embodiment.

In FIG. 24, steps S4201 to S4206 are the same as those in the steps S4101 to S4106 shown in FIG. 21 and therefore will be omitted from description thereof.

In the operation in the fixing stand-by control mode in this embodiment, every predetermined time t (set at 1 minute in this embodiment), switching determination of the stand-by control temperature is made by using an electric power threshold value table shown in Table 2 below. Then, in a period until the operation in the stand-by mode is ended, such as start of print control of a subsequent print job or transfer to a sleep mode as an energy saving mode, a process from S420 to S4208 is repeated.

TABLE 2

| | Current Stand-by Temperature | | | |
|---|---|---|---|---|
| SBT*[1] | T0 (150° C.) | T1 (140° C.) | T2 (130° C.) | T3 (120° C.) |
| T0 | — | 12% | 10% | 8% |
| T1 | 15% | — | 7% | 6% |
| T2 | 10% | 8% | — | 5% |
| T3 | 7% | 6% | 5% | — |

*[1]"SBT" represents the stand-by temperature.

For example, when the current stand-by temperature T1 (=140° C.), values in the column of T1 (140° C.) in Table 2 are used as the electric power threshold. In S4206, in the case where the electric power level W is the threshold of 8% or less, the stand-by temperature is changed to T2 (=130° C.) in S4207, and values in the column of T2 are used as the threshold at subsequent stand-by temperature determination timing. On the other hand, in the case where the electric power level W is larger than the threshold of 12%, the stand-by temperature is changed to T0 (=150° C.) in S4207, and values in the column of T0 are used as the threshold.

This is because the electric power consumption amounts is fluctuated by fluctuation of the stand-by temperature and therefore, in order to accurately detect the degree of warming of the fixing device B, the threshold may preferably be changed depending on the stand-by temperature.

As described above, in the operation in the fixing stand-by control mode, the stand-by control temperature switching determination is made by using the electric power threshold table every predetermined time t, and the process from S4205 to S4208 is repeated until the operation in the stand-by mode is ended. In other words, in the heater temperature control process from S4205 to S4208, in the case where the operation in the fixing stand-by control mode is executed, the stand-by temperature (control temperature) of the heater is set at a value lower, when the electric power consumption amount of the heater during the execution in the operation in the fixing stand-by control mode is small, than when the electric power consumption amount is large.

As described above, the image forming apparatus in this embodiment can accurately determine the degree of warming of the fixing device B by periodically making resetting of the stand-by control temperature during stand-by control. For that reason, compared with the image forming apparatus in Embodiment 4, it is possible to further improve the energy saving property during stand-by control without extending the temperature rising time of the fixing device B.

Further, the image forming apparatus in this embodiment periodically makes resetting of the stand-by control temperature during stand-by control, and then switches, depending on the stand-by temperature, the electric power level threshold for determining the stand-by control temperature. For that reason, even when the degree of warming of the fixing device B is changed, such as in the case where ambient temperature is changed during stand-by control, it is possible to control the temperature of the ceramic heater 416 at a proper stand-by temperature.

In this embodiment, as the operation in the fixing stand-by control mode, the example in which the electric power level is measured every predetermined time t and then the stand-by temperature is reset (changed) was described. The operation in the fixing stand-by control mode in the present invention is not limited thereto, but even when control such that the electric power level is always measured, and then the stand-by temperature is switched at timing when the electric power thresholds at each stand-by temperature are co-present is effected, a similar functional effect can be obtained.

Embodiment 6

An image forming apparatus in this embodiment is the same in constitution as the image forming apparatus in Embodiment 4 except that an operation in a fixing stand-by control mode is different from that in Embodiment 4.

The image forming apparatus in this embodiment is characterized in that during stand-by control, the pressing roller 422 is rotated (finely) by a predetermined distance periodically to rotationally move the surfaces of the pressing roller 422 and the fixing sleeve 420, and after the rotation of the pressing roller 422, stand-by control temperature switching determination is made by measuring the level of the electric power applied to the ceramic heater 416 and then by using a value of the measured electric power level integrated for a predetermined time.

FIG. 25 is a flowchart of an operation in a fixing stand-by control mode of the image forming apparatus in this embodiment.

In FIG. 25, steps S4301 to S4305 and S4307 are the same as those in the steps S4101 to S4106 shown in FIG. 21 and therefore will be omitted from description thereof.

In the operation in the fixing stand-by control mode in this embodiment, every predetermined time t, the pressing roller 422 is finely rotated by a predetermined distance L1 to rotationally move the surfaces of the pressing roller 422 and the fixing sleeve 420 (S4306). Then, an average electric power level Wa in a predetermined time range t1 after the fine rotation of the pressing roller 422 is calculated, and then stand-by control temperature switching determination is made by using a electric power threshold table shown in Table 3 below, thus completing the operation in the fixing stand-by control mode (S4307 to S4309). In this embodiment, t=10 min., L1=30 mm and t1=2 sec were set.

As described above, in the operation in the fixing stand-by control mode, the stand-by control temperature switching determination is made by using the electric power threshold table every predetermined time t, and the process from S4305 to S4309 is repeated until the operation in the stand-by mode is ended. In other words, in the heater temperature control process from S4305 to S4309, in the case where the operation in the fixing stand-by control mode is executed, the stand-by temperature (control temperature) of the heater is set at a value lower, when the electric power consumption amount of the heater during the execution in the operation in the fixing stand-by control mode is small, than when the electric power consumption amount is large.

FIG. 26 shows electric power level progression when the pressing roller 422 is finely rotated. According to FIG. 26, by finely rotating the pressing roller 422, the surfaces of the pressing roller 422 and the fixing sleeve 420 which are not directly warmed by the ceramic heater 416 are moved. As a result, the electric power consumption amount of the ceramic heater 416 is temporarily increased in order to maintain the stand-by temperature of the ceramic heater 416, and therefore it is possible to accurately measure the degree of warming particularly of the fixing sleeve 420 and the pressing roller 422.

At the distance L1, in order to accurately measure the warming degree of the fixing sleeve 420 and the pressing roller 422, the fixing sleeve 420 may desirably be rotated by a predetermined distance. That is, the fixing sleeve 420 may desirably be rotated by a distance such that a region thereof at the fixing nip N before the rotational movement and a region thereof at the fixing nip N after the rotational movement do not overlap with each other. In other words, the distance L1 may desirably be set so that rotation stop positions of the fixing sleeve 420 and the pressing roller 422 do not overlap with those in the preceding rotation in the distance L1.

TABLE 3

| | Current Stand-by Temperature | | | |
|---|---|---|---|---|
| SBT*[1] | T0 (150° C.) | T1 (140° C.) | T2 (130° C.) | T3 (120° C.) |
| T0 | — | 40% | 33% | 28% |
| T1 | 50% | — | 23% | 20% |
| T2 | 35% | 28% | — | 15% |
| T3 | 25% | 20% | 17% | — |

*[1]"SBT" represents the stand-by temperature.

As described above, the image forming apparatus in this embodiment can accurately determine the degree of warming of the fixing device B by periodically rotating the pressing roller 422 finely and then by measuring the electric power level. For that reason, compared with the image forming apparatus in Embodiment 4, it is possible to further improve the energy saving property during stand-by control without extending the temperature rising time of the fixing device B.

In this embodiment, the example in which the electric power threshold table using four stand-by temperature levels and three stand-by switching threshold levels is used is described, but by further increasing these levels, it is possible to flexibly set the stand-by temperature.

Other Embodiments

In Embodiment 4, the example in which the stand-by temperature is controlled on the basis of the temperature information of the heater thermistor 419 is described, but the stand-by temperature control is not limited to that on the basis of the temperature information. The stand-by temperature may also be controlled on the basis of a detected temperature of the ceramic heater 416 indirectly detected on the basis of the temperature information of the sleeve thermistor 418. In this case, the operation in the fixing stand-by control mode in the present invention is applicable to various fixing devices shown in FIGS. 27 to 30.

FIG. 27 is a cross-sectional view showing a general structure of a fixing device B of a film heating type using a halogen lamp 451. The fixing device B shown in FIG. 27 uses a rotatable cylindrical fixing sleeve 420 as the fixing member and a rotatable pressing roller 422 as the pressing member. Inside the fixing sleeve 420, a holder 417 on which a slidable plate 454 is supported is provided. Further, by pressing the slidable plate 454 by the holder 417 toward the pressing roller 422 via the fixing sleeve 420, a fixing nip N is formed between the surface of the fixing sleeve 420 and the surface of the pressing roller 422.

Inside the fixing sleeve 420, the halogen lamp 451 as a heating member and heats the fixing sleeve 420 from an inner surface side of the fixing sleeve 420. A temperature of the fixing sleeve 420 is detected by the sleeve thermistor 418.

FIG. 28 is a cross-sectional view showing a general structure of a fixing device B of a film heating type using electromagnetic induction heating. The fixing device B shown in FIG. 28 uses a rotatable cylindrical fixing sleeve 420 as the fixing member and a rotatable pressing roller 422 as the pressing member. Inside the fixing sleeve 420, a sleeve guide 417 on which an exciting coil 452, a magnetic core 453 and a slidable plate 454 are supported is provided. Further, by pressing the slidable plate 454 by the sleeve guide 417 toward the pressing roller 422 via the fixing sleeve 420, a fixing nip N is formed between the surface of the fixing sleeve 420 and the surface of the pressing roller 422.

The fixing sleeve 420 generates Joule heat on the surface of the fixing sleeve 420 by magnetic flux generated by the exciting coil 452, and thus is heated by the electromagnetic induction heating. A temperature of the fixing sleeve 420 is detected by the sleeve thermistor 418.

As described above, each of the fixing devices shown in FIGS. 27 and 28 include the slidable plate 454 for forming the fixing nip between the fixing sleeve 420 and the pressing roller 422.

FIG. 29 is a cross-sectional view showing a general structure of a fixing device B of a belt pressing fixing type using a pressing belt 456. The fixing device B shown in FIG. 29 uses a rotatable fixing roller 450 as the fixing member and a rotatable cylindrical pressing belt 456 as the pressing member. Inside the pressing belt 456, a pressing pad holder 457 on which a pressing pad 455 is supported is provided. Further, by pressing the pressing pad 455 by the pressing pad holder 457 toward the fixing roller 450 via the pressing belt 456, a fixing nip N is formed between the surface of the pressing belt 456 and the surface of the fixing roller 450.

Inside the fixing roller 450, a halogen lamp 451 as a heating member is provided (incorporated) and heats the fixing roller 450 from an inner surface side of the fixing roller 450. A temperature of the fixing roller 450 is detected by the sleeve thermistor 418.

FIG. 30 is a cross-sectional view showing a general structure of a fixing device B of a heating roller type. The fixing device B shown in FIG. 30 uses a rotatable fixing roller 450 as the fixing member and a rotatable pressing roller 422 as the pressing member. Further, by pressing the pressing roller 422 toward the fixing roller 450, a fixing nip N is formed between the surface of the fixing roller 450 and the surface of the pressing roller 422.

Inside the fixing roller 450, a halogen lamp 451 as a heating member is provided and heats the fixing roller 450 from an inner surface side of the fixing roller 450. A temperature of the fixing roller 450 is detected by the sleeve thermistor 418.

Even when the operation in the fixing stand-by control mode described in Embodiments 4 to 6 is applied to the fixing devices B shown in FIGS. 27 to 30, a similar functional effect can be obtained. In addition, it is possible to make any modifications within a technical concept of the present invention.

In Embodiments 4 to 6, the example in which non-continuous values are set with respect to values of the stand-by temperature and the threshold for determining the stand-by temperature is described, but the values of the stand-by temperature and the threshold are not limited thereto.

For example, it is possible to use any control method, within the technical concept of the present invention, such as determination based on a predetermined calculation expression after an optimum stand-by temperature depending on a measured electric power amount is stored in the electric power supply controller 4211 of the heater driving circuit 421. That is, in the electric power supply controller 4211, the calculation expression for determining the ceramic heater stand-by temperature (control temperature) when the operation in the fixing stand-by control mode is executed is stored. The calculation expression varies depending on the ceramic heater stand-by temperature before the ceramic heater stand-by temperature is determined.

The apparatus in which the above-described operation in the fixing stand-by control mode is performed is not limited to the full-color laser beam printer, but may also be a monochromatic copying machine and a monochromatic laser beam printer.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 221314/2012 filed Oct. 3, 2012 and 235436/2012 filed Oct. 25, 2012, which are hereby incorporated by reference.

What is claimed is:

1. An image forming apparatus comprising:

a fixing portion for fixing an image, formed on a recording material, on the recording material;

an electric power consumption calculating portion for calculating electric power consumption of said fixing portion, wherein said calculating portion calculates the electric power consumption at a control target temperature during a stand-by mode in which said fixing portion awaits a print instruction; and a temperature setting portion for setting, depending on the electric power consumption calculated by said calculating portion, the control target temperature during the stand-by mode.

2. An apparatus according to claim 1, wherein said temperature setting portion sets the control target temperature at a lower value with a smaller value of the electric power consumption.

3. An apparatus according to claim 1, wherein said fixing portion includes an endless film contactable with the image on the recording material.

4. An apparatus according to claim 3, wherein a heater contacts an inner surface of the endless film.

5. An apparatus according to claim 1, wherein during the stand-by mode, said temperature setting portion periodically resets the control target temperature during the stand-by mode.

6. An apparatus according to claim 1, wherein said fixing portion includes an endless film contactable with the image on the recording material and a pressure roller for forming a nip together with the endless film, wherein during the stand-by mode, said pressure roller periodically rotates, and wherein said calculating portion calculates the electric power consumption of said fixing portion after rotation of said pressure roller.

* * * * *